US006167713B1

(12) United States Patent
Hartfield et al.

(10) Patent No.: US 6,167,713 B1
(45) Date of Patent: Jan. 2, 2001

(54) FALLING FILM EVAPORATOR HAVING TWO-PHASE DISTRIBUTION SYSTEM

(75) Inventors: Jon P. Hartfield; Shane A. Moeykens; James W. Larson, all of La Crosse, WI (US)

(73) Assignee: American Standard Inc., Piscataway, NJ (US)

( * ) Notice: Under 35 U.S.C. 154(b), the term of this patent shall be extended for 0 days.

(21) Appl. No.: 09/267,413

(22) Filed: Mar. 12, 1999

(51) Int. Cl.[7] ..... F25B 1/00

(52) U.S. Cl. ..... 62/115; 165/160; 165/DIG. 171; 62/525

(58) Field of Search ..... 62/525, 115; 1651/160, 1651/115, DIG. 171

(56) References Cited

U.S. PATENT DOCUMENTS

| | | | |
|---|---|---|---|
| 1,937,802 | | 12/1933 | Baer . |
| 2,012,183 | | 8/1935 | Carrier . |
| 2,059,725 | | 11/1936 | Carrier . |
| 3,213,935 | | 10/1965 | Reid, Jr. . |
| 3,412,569 | | 11/1968 | Arledge, Jr. . |
| 3,635,040 | | 1/1972 | Morris, Jr. . |
| 4,018,583 | * | 4/1977 | Patnode et al. ..... 62/115 |
| 4,254,825 | * | 3/1981 | Imazu ..... 165/160 |
| 4,437,322 | * | 3/1984 | Ertinger ..... 62/115 |
| 4,567,942 | * | 2/1986 | Stafford et al. ..... 165/DIG. 171 |
| 4,576,222 | | 3/1986 | Granata, Jr. et al. . |
| 5,561,987 | | 10/1996 | Hartfield et al. ..... 62/471 |
| 5,588,596 | | 12/1996 | Hartfield et al. ..... 239/542 |
| 5,638,691 | | 6/1997 | Hartfield et al. ..... 62/219 |
| 5,645,124 | | 7/1997 | Hartfield et al. ..... 165/117 |
| 5,761,914 | | 6/1998 | Carey et al. ..... 62/84 |
| 5,836,382 | | 11/1998 | Dingle et al. ..... 165/160 |
| 5,839,294 | | 11/1998 | Chiang et al. . |

* cited by examiner

*Primary Examiner*—Ronald Capossela
(74) *Attorney, Agent, or Firm*—William J. Beres; William O'Driscoll; Peter D. Ferguson

(57) ABSTRACT

Efficient two-phase refrigerant mixture distribution is accomplished in a falling film evaporator by use of a refrigerant distributor disposed internal of the evaporator shell which overlies the evaporator tube bundle and which internally causes said two-phase refrigerant mixture to be made available along essentially the entire length and across essentially the entire width of the tube bundle prior to the delivery of the refrigerant out of the distributor.

69 Claims, 10 Drawing Sheets

FALLING FILM EVAPORATOR HAVING TWO-PHASE DISTRIBUTION SYSTEM

BACKGROUND OF THE INVENTION

The present invention relates to the distribution of a two-phase refrigerant mixture in the evaporator of a refrigeration system. More particularly, the present invention relates to the uniform distribution of saturated two-phase refrigerant over and onto the tube bundle in a falling film evaporator used in a refrigeration chiller.

The primary components of a refrigeration chiller include a compressor, a condenser, an expansion device and an evaporator. High pressure refrigerant gas is delivered from the compressor to the condenser where the refrigerant gas is cooled and condensed to the liquid state. The condensed refrigerant passes from the condenser to and through the expansion device. Passage of the refrigerant through the expansion device causes a pressure drop therein and the further cooling thereof. As a result, the refrigerant delivered from the expansion device to the evaporator is a relatively cool, saturated two-phase mixture.

The two-phase refrigerant mixture delivered to the evaporator is brought into contact with a tube bundle disposed therein and through which a relatively warmer heat transfer medium, such as water, flows. That medium will have been warmed by heat exchange contact with the heat load which it is the purpose of the refrigeration chiller to cool. Heat exchange contact between the relatively cool refrigerant and the relatively warm heat transfer medium flowing through the tube bundle causes the refrigerant to vaporize and the heat transfer medium to be cooled. The now cooled medium is returned to the heat load to further cool the load while the heated and now vaporized refrigerant is directed out of the evaporator and is drawn into the compressor for recompression and delivery to the condenser in a continuous process.

More recently, environmental, efficiency and other similar issues and concerns have resulted in a need to re-think evaporator design in refrigeration chillers in view of making such evaporators more efficient from a heat exchange efficiency standpoint and in view of reducing the size of the refrigerant charge needed in such chillers. In that regard, environmental circumstances relating to ozone depletion and environmental warming have taken on significant importance in the past several years. Those issues and the ramifications thereof have driven both a need to reduce the amount and change the nature of the refrigerant used in refrigeration chillers.

So-called falling film evaporators, which are known in the industry, but which are not in widespread use, have for some time been identified as appropriate for use in refrigeration chillers to address efficiency, environmental and other issues and concerns in the nature of those referred to above. While the use and application of evaporators of a falling film design in refrigeration chillers is theoretically beneficial, their design, manufacture and incorporation into chiller systems has proven challenging, particularly with respect to the need to uniformly distribute refrigerant across the tube bundles therein. Uniform distribution of the refrigerant delivered into such evaporators in a refrigeration chiller application is critical to the efficient operation of both the evaporator and the chiller as a whole, to the structural design of the apparatus by which such distribution is accomplished and to reducing the size of the chiller's refrigerant charge without compromising chiller reliability. Achieving the uniform distribution of refrigerant is also a determining factor in the success and efficiency of the process by which oil, which migrates into the evaporator, is returned thereoutof to the chiller's compressor. The efficiency of the process by which oil is returned from a chiller's evaporator affects both the quantity of oil that must be available within the chiller and chiller efficiency. U.S. Pat. No. 5,761,914, assigned to the assignee of the present invention, may be referred to in that regard.

Exemplary of the current use of falling film evaporators in refrigeration chillers is the relatively new, so-called RTHC chiller manufactured by the assignee of the present invention. In addition to the '914 patent referred to above, reference may be had to U.S. Pat. Nos. 5,645,124; 5,638,691 and 5,588,596, likewise assigned to the assignee of the present invention and all of which derive from a single U.S. patent application, for their description of early efforts as they relate to the design of falling film evaporators for use in refrigeration chillers and refrigerant distribution systems therefor. Reference may also be had to U.S. Pat. No. 5,561,987, likewise assigned to the assignee of the present invention, which similarly relates to a chiller and chiller system that makes use of a falling film evaporator.

In the RTHC chiller, which is currently state of the art in the industry, the refrigerant delivered to the falling film evaporator is not a two-phase mixture but is in the liquid state only. As will be apparent to those skilled in the art, uniform distribution of liquid-only refrigerant is much more easily achieved than is distribution of a two-phase refrigerant mixture. The delivery of liquid-only refrigerant for distribution over the tube bundle in the falling film evaporator in the RTHC chiller, while making uniform refrigerant distribution easier to achieve, is achieved at the cost and expense of needing to incorporate a separate vapor-liquid separator component in the chiller upstream of the evaporator's refrigerant distributor. The separate vapor-liquid separator component in the RTHC chiller adds significant expense thereto, in the form of material and chiller fabrication costs, such vapor-liquid separator component being a so-called ASME pressure vessel which is relatively expensive to fabricate and incorporate into a chiller system.

While the RTHC chiller is a screw-compressor based chiller, it is to be understood that it is but one example of the kinds of chiller systems with which falling film evaporators can be used. The immediate prospects for use of such evaporators in centrifugal and other chillers is therefore contemplated as will be appreciated from the Description of the Preferred Embodiment which follows.

The need exists for a falling film evaporator for use in refrigeration chiller systems and for a refrigerant distributor therefor which, irrespective of the nature of the compressor by which the chiller is driven, achieves the uniform distribution of two-phase refrigerant to the chiller's evaporator tube bundle without the need for apparatus the purpose of which is to separate the two-phase refrigerant mixture into vapor and liquid components prior to the delivery thereof into the evaporator and/or into the refrigerant distribution apparatus therein.

SUMMARY OF THE INVENTION

It is an object of the present invention to provide a falling film evaporator for use in a refrigeration chiller in which a two-phase mixture of refrigerant delivered into the evaporator is uniformly distributed into heat exchange contact with the evaporator's tube bundle.

It is also an object of the present invention to eliminate the need for separate apparatus or methodology by which to achieve vapor-liquid separation in the refrigerant delivered from an expansion device to a falling film evaporator in a refrigeration chiller prior to receipt of such refrigerant in the evaporator's refrigerant distributor.

It is another object of the present invention to provide a refrigerant distributor for use in a falling film evaporator which, by the use of staged steps of flow, results in the controlled and/or uniform expression of refrigerant thereoutof along the length and across the width of the tube bundle in the evaporator.

It is also object of the present invention to provide a distributor for a falling film evaporator in a refrigeration chiller which minimizes the pressure drop in the distributed refrigerant which is attributable to the distribution process and/or apparatus.

It is, in the same vein, an object of the present invention to provide a distributor for a falling film evaporator which achieves uniform distribution of a two-phase refrigerant mixture without having to resort to devices/structure which increase the pressure of the refrigerant mixture internal of the distributor to achieve such uniform distribution thereof.

It is a still further object of the present invention to provide a distributor for two-phase refrigerant in a falling film evaporator in a refrigeration chiller which provides for the absorption of kinetic energy in the refrigerant prior to the delivery/deposit of the liquid portion of the refrigerant into contact with the evaporator's tube bundle so as to minimize the disruption of the delivery thereof into heat exchange contact with the tube bundle.

It is an additional object of the present invention to provide a refrigeration chiller which is more efficient, in which the size of the refrigerant charge is reduced and in which oil-return to the chiller's compressor is enhanced, at least partially as a result of the use in the chiller of a falling film evaporator and the accomplishment of uniform distribution of refrigerant across the tube bundle therein by apparatus which does not require separation of the liquid and gas components of the refrigerant yet which is economical of manufacture.

These and other objects of the present invention, which will become apparent when the following Description of the Preferred Embodiment and appended drawing figures are considered, are achieved by the disposition of a refrigerant distributor in the falling film evaporator of a refrigeration chiller which receives a two-phase refrigerant mixture from an expansion device and which by (1) the use of staged steps of distribution internal of the distributor, (2) maintenance of essentially constant flow velocity in the refrigerant mixture in each of the initial stages of the distribution process and (3) arrest of the mixture's kinetic energy in a final stage of distribution, prior to its issuance from the distributor, results in the expression of uniform quantities of liquid refrigerant in droplet form and in a drip-like fashion essentially along the entire length and across the entire width of the evaporator's tube bundle. Uniform distribution is achieved by first axially flowing the two-phase refrigerant mixture within the distributor through a passage the geometry of which maintains the flow velocity thereof essentially constant. By doing so, such two-phase refrigerant is made available along the entire length of the distributor and along the length of the tube bundle it overlies. The refrigerant is then flowed transversely internal of the distributor through passages of similar geometry which likewise maintains refrigerant flow therein at essentially constant velocity. The kinetic energy of the refrigerant is then absorbed, prior to its expression out of the distributor and into contact with the evaporator's tube bundle, in what can be categorized as a third stage of distribution internal of the distributor, so that the liquid refrigerant delivered out of the distributor and onto the tube bundle is in the form of large, low energy droplets that are dribbled in a uniform fashion onto the tubes in the upper portion of the evaporator's tube bundle. Achievement of such uniform distribution across the length and width of the tube bundle enhances the efficiency of the heat exchange process within the evaporator, enhances the process by which oil is returned thereoutof back to the chiller's compressor and permits a reduction in the size of the refrigerant charge on which the chiller is run.

DESCRIPTION OF THE DRAWING FIGURES

Figure 6:
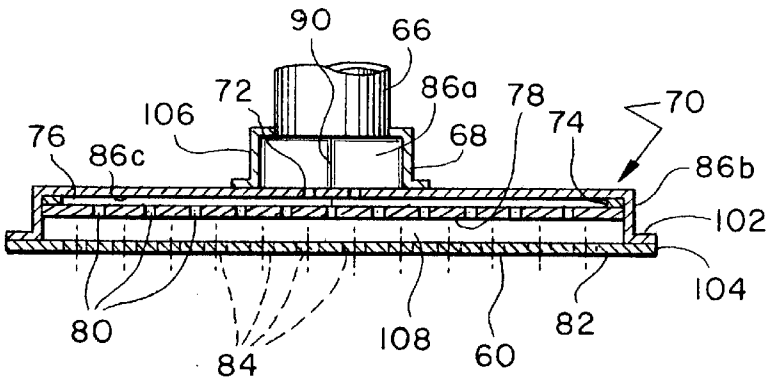
FIG. 6 is taken along line 6—6 of FIG. 5.
Figure 6A:
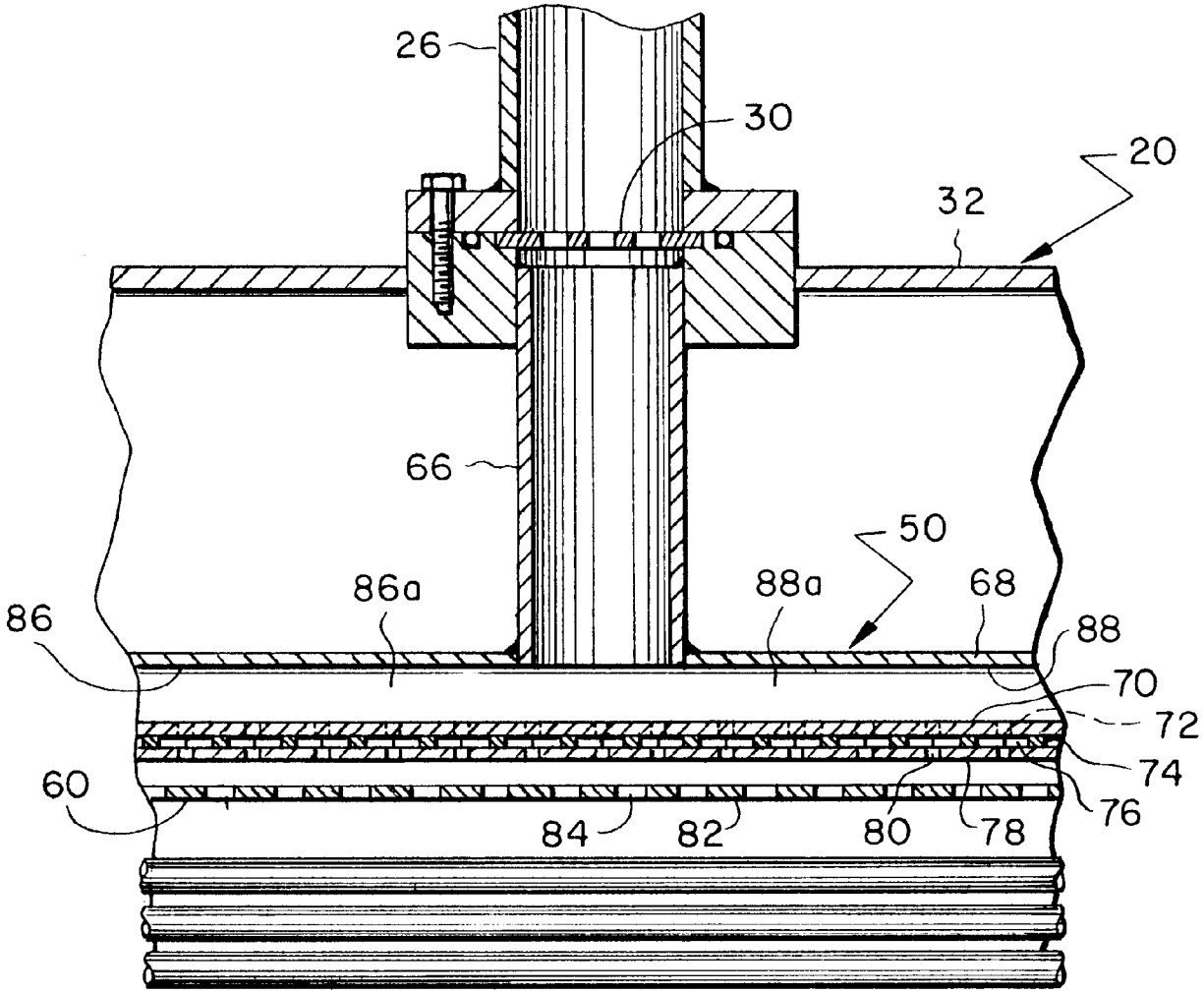

FIG. 6*a* is an enlarged sectional view of the upper portion of the evaporator of the present invention illustrating the disposition of an expansion device in that location.

Figure 5:
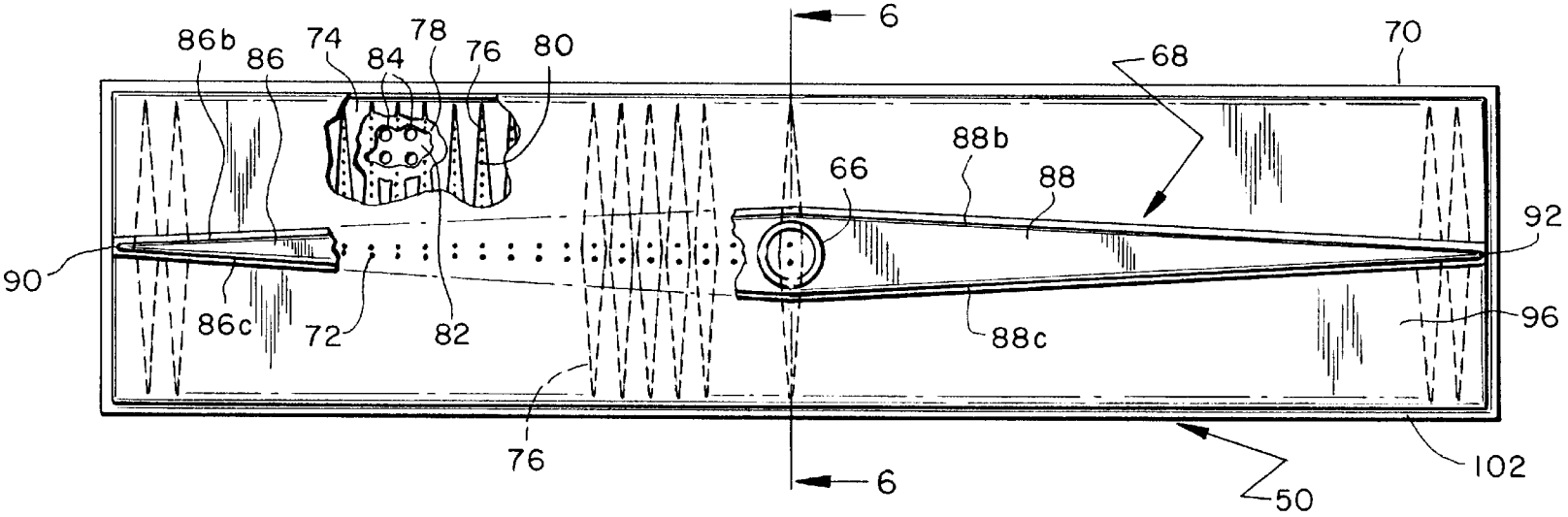
FIG. 5 is a top view of the refrigerant distributor of FIG. 4.
Figure 7:
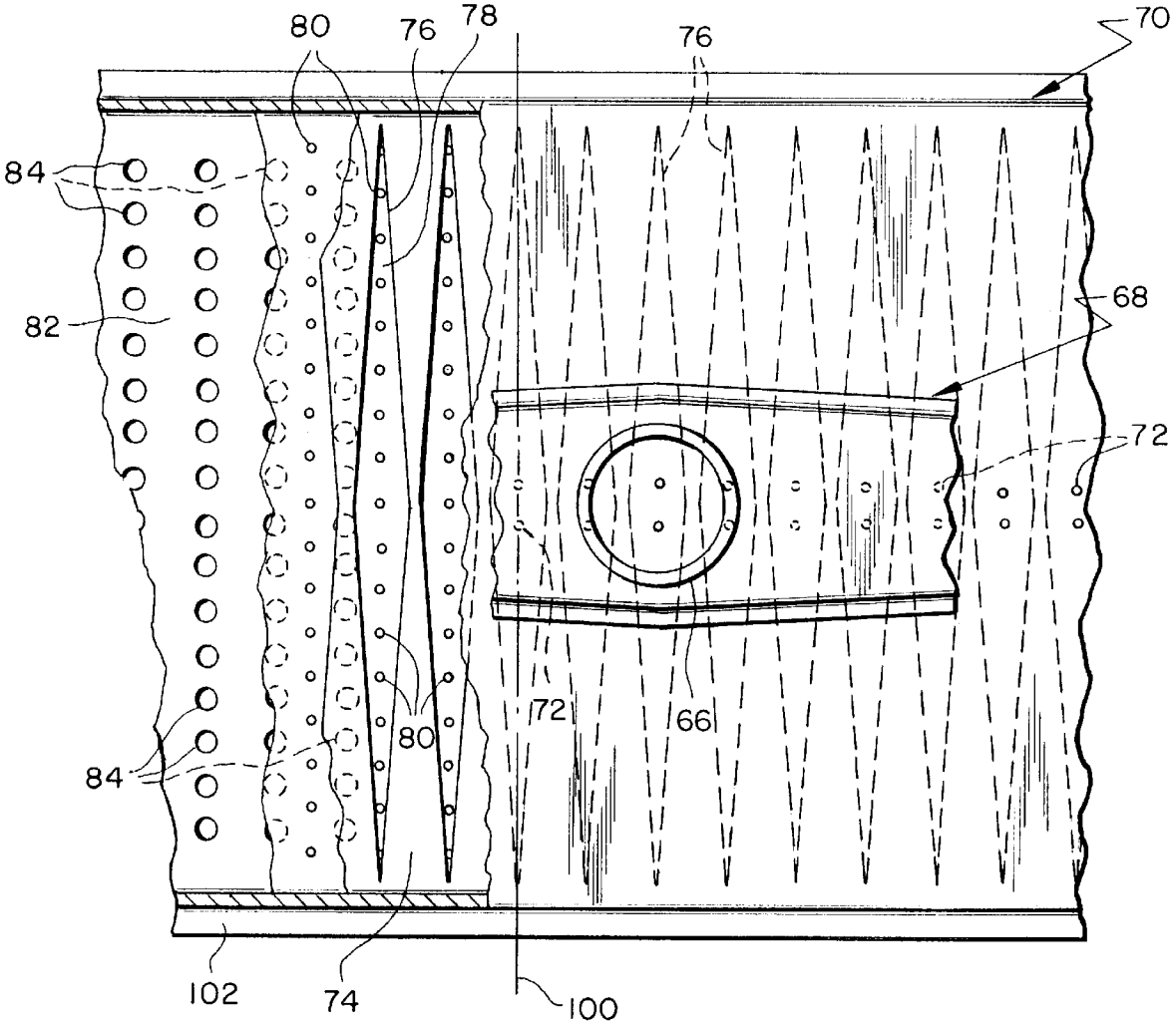

FIG. 7 is an enlarged partial cutaway view of a portion of FIG. 5.

Figure 8:
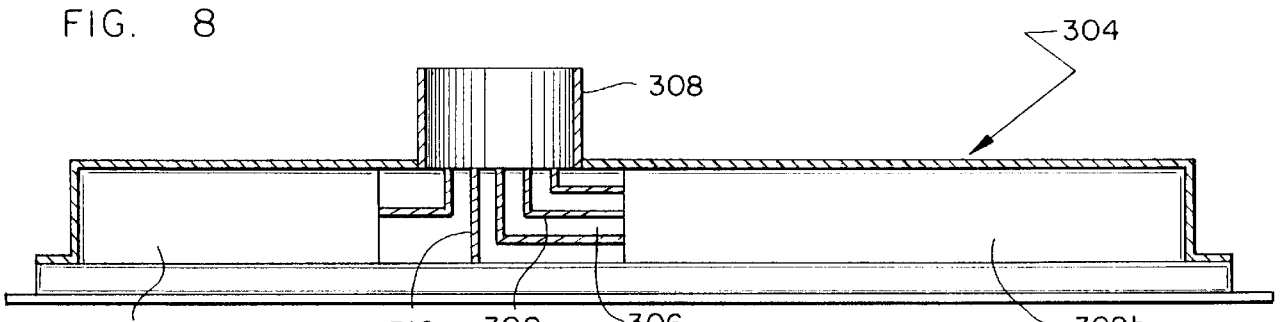

FIG. 8 is a schematic cross-section of a first stage distribution portion in which guide vanes and a flow splitter are employed.

Figure 9:
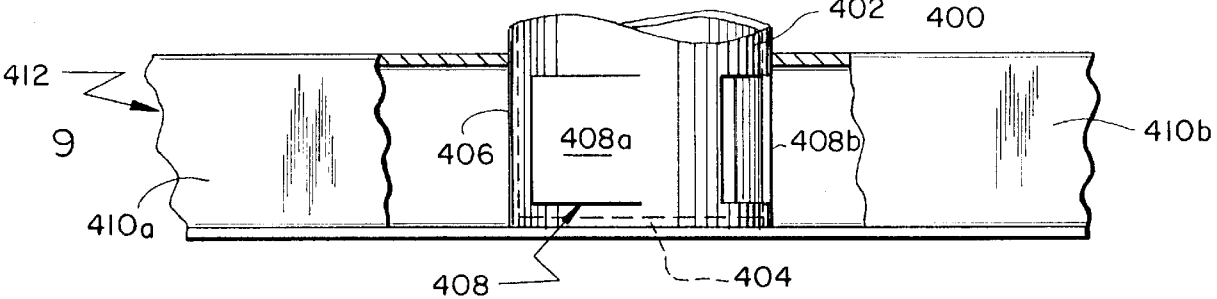
Figure 10:
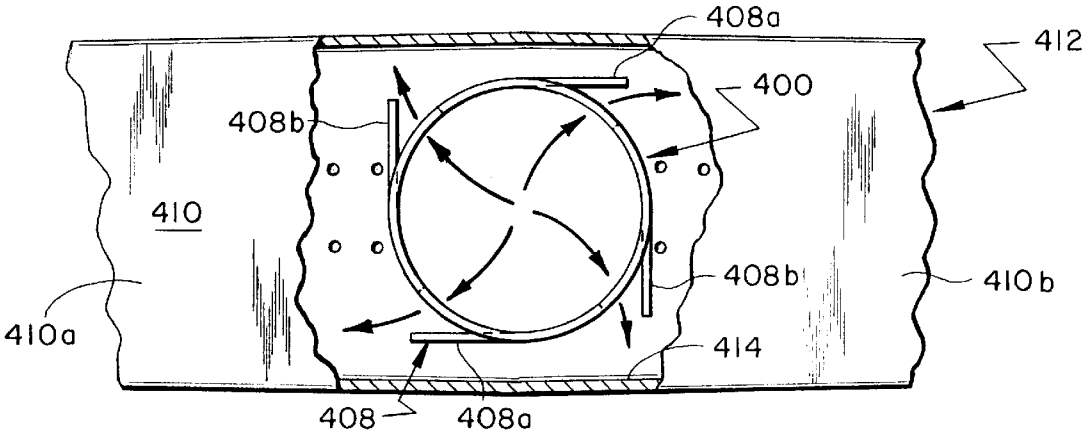

FIGS. 9 and 10 are schematic side and top views of a rotary inlet flow distributor.

Figure 11:
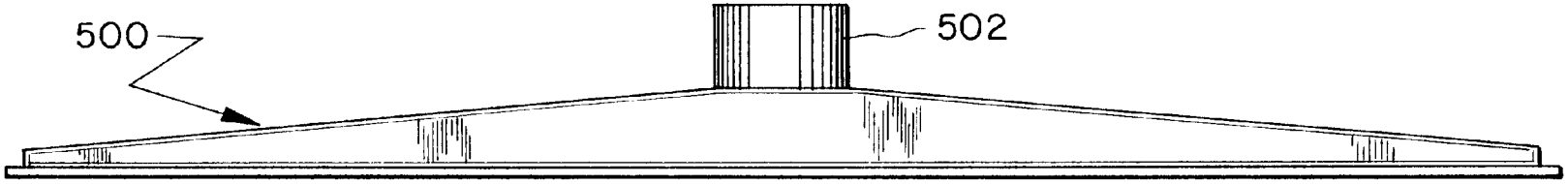
Figure 12:
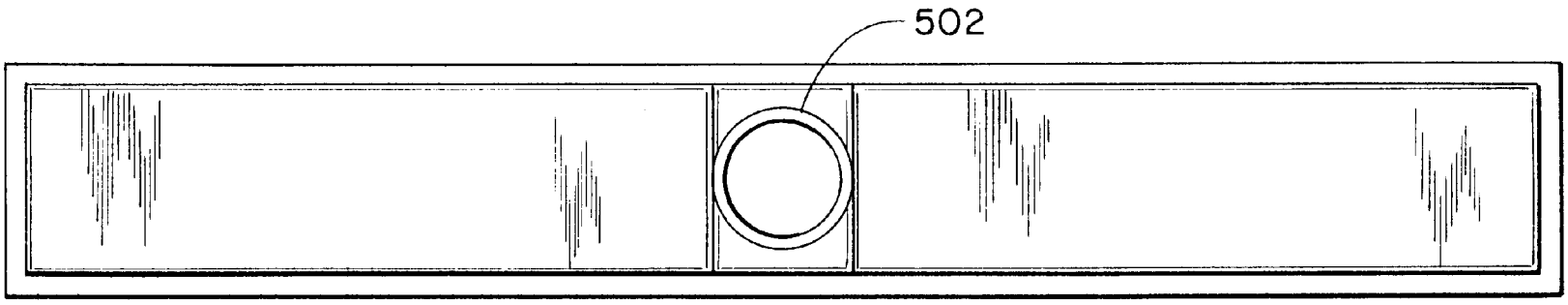

FIGS. 11 and 12 are schematic views of a first stage distributor of an alternate design.

Figure 13:
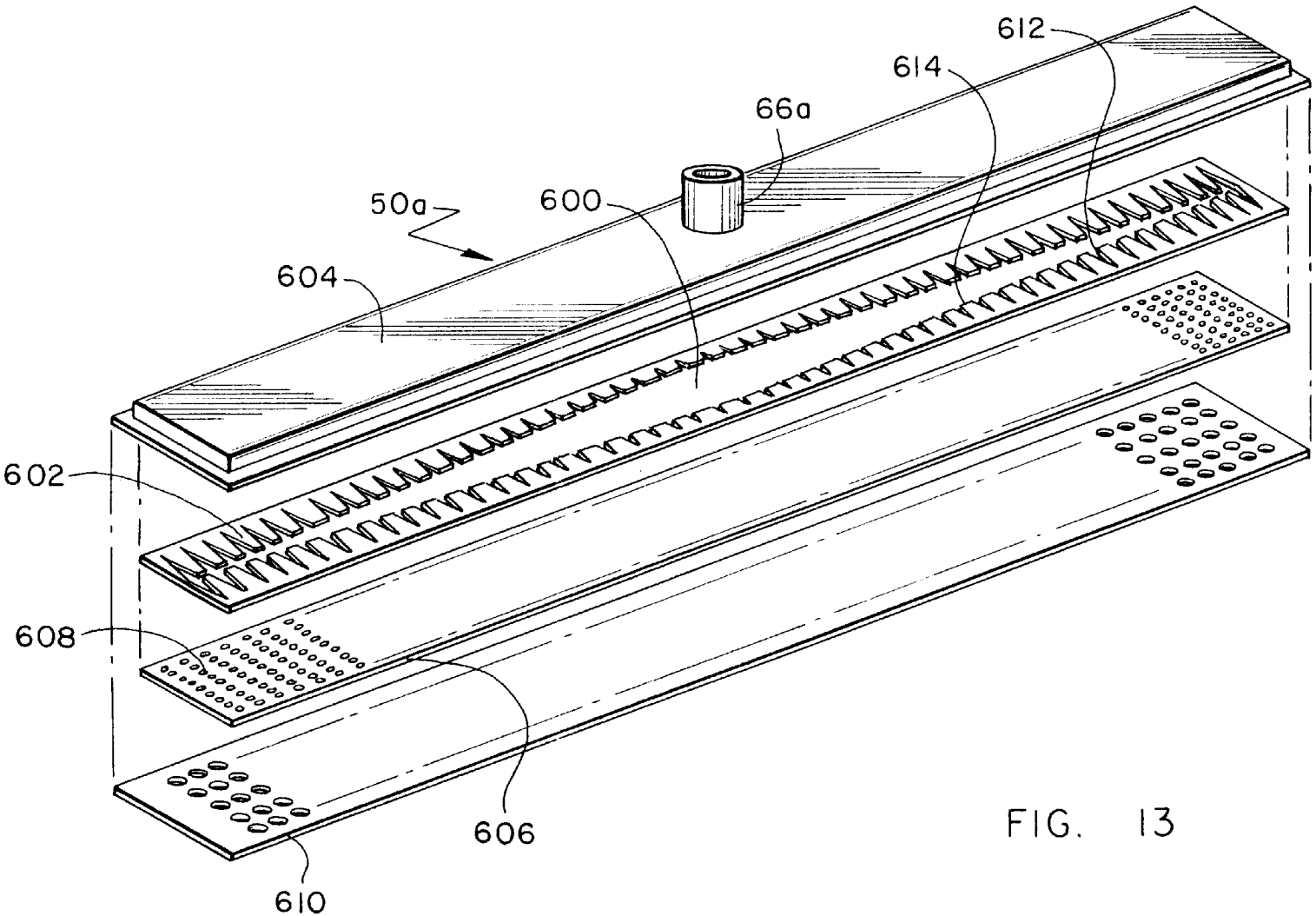

FIG. 13 is an exploded view of an alternate embodiment of the refrigerant distributor of the present invention.

Figure 14:
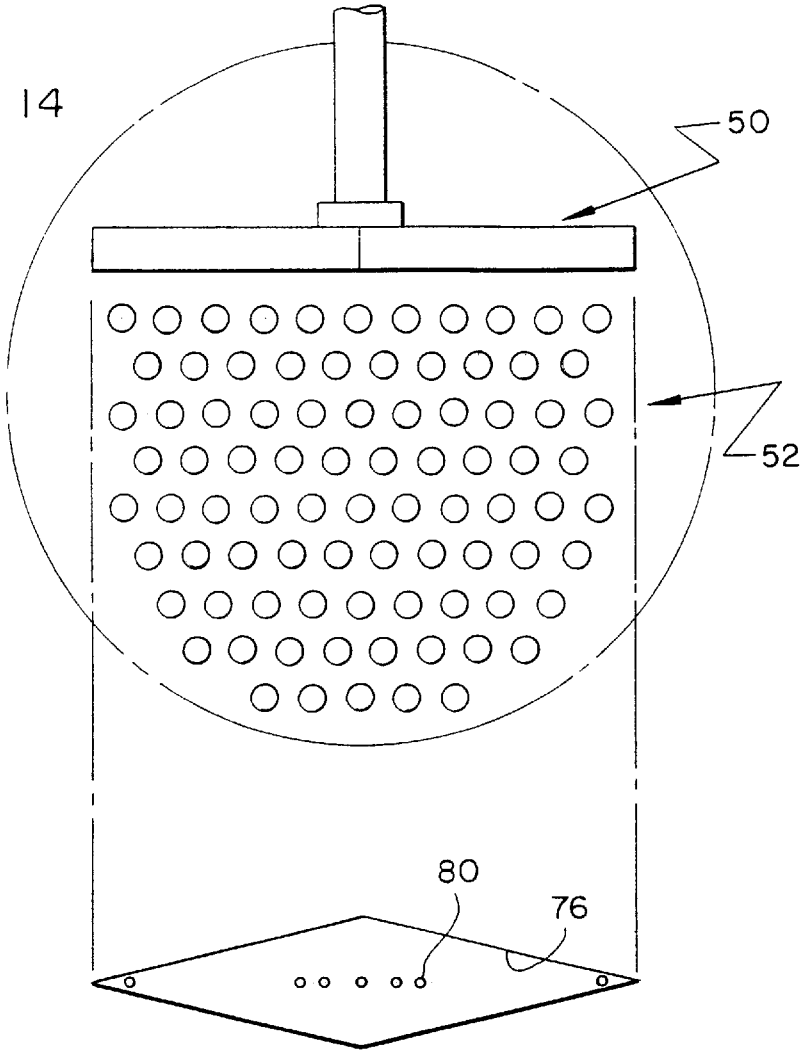

FIG. 14 illustrates an alternate embodiment of the present invention in which the holes through which refrigerant passes into the distribution volume of the distributor of the present invention are non-uniformly spaced to "tailor" the distribution of refrigerant in accordance with the tube pattern in the tube bundle overlain by the distributor.

Figure 15:
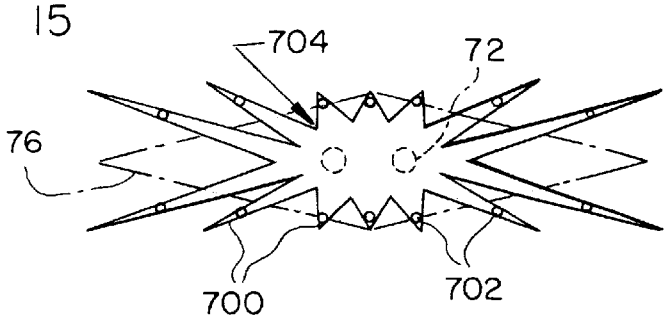

FIG. 15 is an alternate embodiment of the distributor of the present invention illustrating an alternate geometry for the passage by which two-phase refrigerant mixture is distributed across the width of the tube bundle overlain by the distributor.

DESCRIPTION OF THE PREFERRED EMBODIMENT

Figure 1:
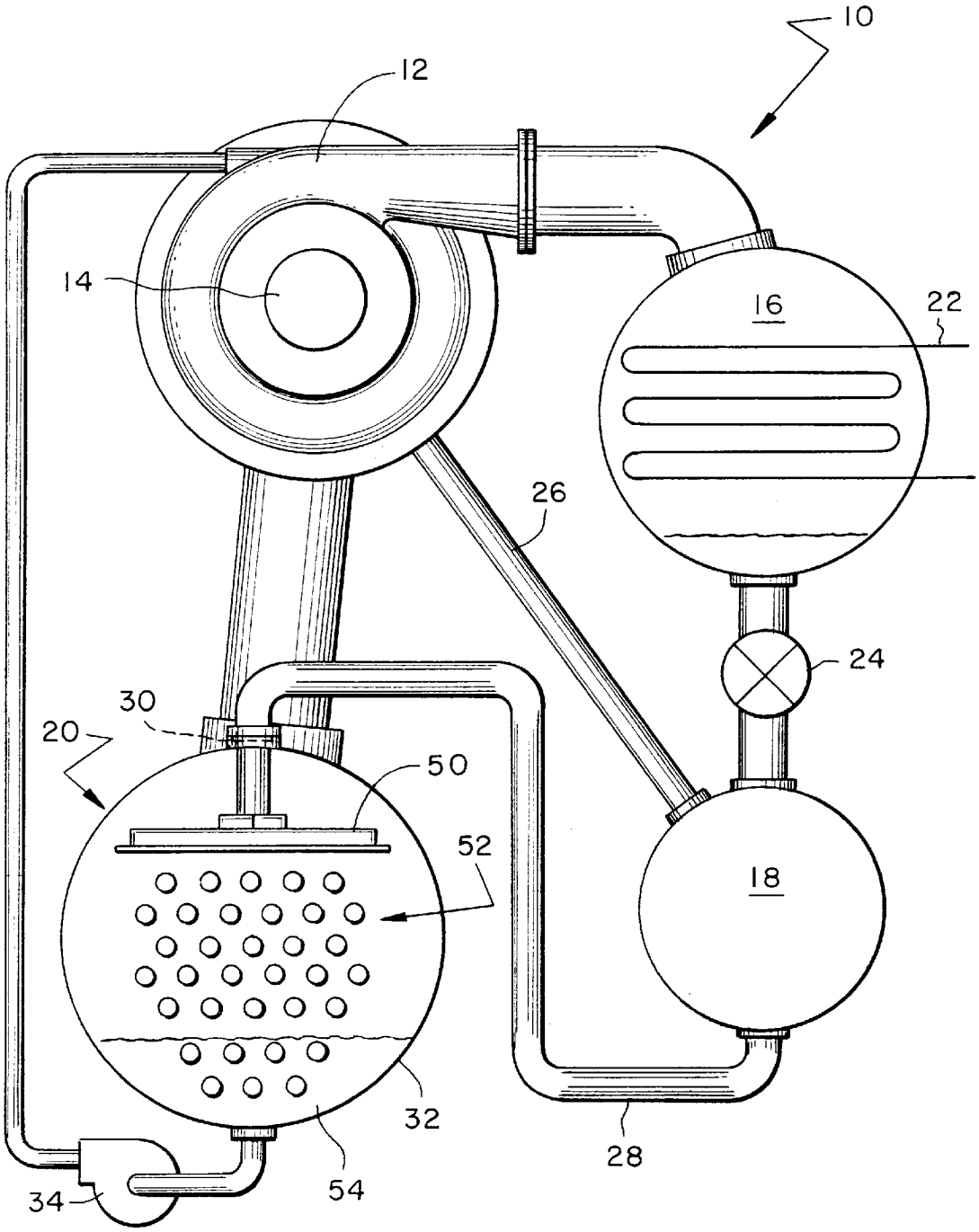
FIG. 1 is a schematic illustration of the water chiller of the present invention in which the falling film evaporator and the refrigerant distributor of the present invention are employed.

Referring first to FIG. 1, the primary components of chiller system 10 are a compressor 12 which is driven by a motor 14, a condenser 16, an economizer 18 and an evaporator 20. These components are serially connected for refrigerant flow in a basic refrigerant circuit as will more thoroughly be described.

Compressor 12 is, in the preferred embodiment, a compressor of the centrifugal type. It is to be understood, however, that the use of falling film evaporators and refrigerant distributors of the type described herein in chillers where the compressor is of other than the centrifugal type is contemplated and falls within the scope of the present invention.

Generally speaking, the high pressure refrigerant gas delivered into condenser 16 is condensed to liquid form by heat exchange with a fluid, most typically water, which is delivered through piping 22 into the condenser. As will be the case in most chiller systems, a portion of the lubricant used within the compressor will be carried out of the compressor entrained in the high pressure gas that is discharged thereoutof. Any lubricant entrained in the compressor discharge gas will fall or drain to the bottom of the condenser and make its way into the condensed refrigerant pooled there.

The liquid pooled at the bottom of the condenser is driven by pressure out of the condenser to and through, in the case of the preferred embodiment, a first expansion device 24 where a first pressure reduction in the refrigerant occurs. This pressure reduction results in the creation of a two-phase refrigerant mixture downstream of the expansion device which carries entrained lubricant with it. The two-phase refrigerant mixture and any lubricant flowing therewith is delivered into economizer 18 from where the majority of the gaseous portion of the two-phase refrigerant, which is still at relatively high pressure, is delivered through conduit 26 back to compressor 12 which, in the case of the preferred embodiment, is a two-stage compressor.

The delivery of such gas back to compressor 12 is to a location where the refrigerant undergoing compression within the compressor is at a relatively lower pressure than the gas delivered thereinto from the economizer. The delivery of the relatively higher pressure gas from the economizer into the lower pressure gas stream within the compressor elevates the pressure of the lower pressure refrigerant gas by mixing with it and without the need for mechanical compression. The economizer function is well known and its purpose is to save energy that would otherwise be used by motor 14 in driving compressor 12. It is to be understood that while the preferred embodiment describes a chiller in which a multiple stage centrifugal compressor and an economizer are is employed, the present invention is equally applicable, not only to chillers driven by other kinds of compressors, but to centrifugal machines which employ only a single stage or more than two stages of compression and/or which may or may not employ an economizer component.

The refrigerant that exits economizer 18 passes through piping 28 and is delivered to a second expansion device 30. Second expansion device 30 is, as will further be described, advantageously disposed in or at the top of shell 32 of evaporator 20, proximate refrigerant distributor 50 which is disposed therein. A second pressure reduction in the refrigerant occurs as a result of the passage of the refrigerant through second expansion device 30 and relatively low pressure two-phase refrigerant mixture is delivered from second expansion device 30, together with any lubricant being carried therein, into the refrigerant distributor.

As will more thoroughly be described, the uniform deposition of the two-phase refrigerant mixture received from second expansion device 30 as well as any lubricant entrained therein along the length and across the width of tube bundle 52 of evaporator 20 by distributor 50 results in the highly efficient vaporization of the liquid refrigerant portion of the mixture as it comes into heat exchange contact with the tubes in the evaporator's tube bundle as well as the flow of lubricant and a relatively small amount of liquid refrigerant, indicated at 54, into the bottom of the evaporator. The vapor portion of the two-phase mixture originally delivered into distributor 50, together with any vapor formed therein or which is initially formed within shell 32 of the evaporator after issuing from distributor 50 in liquid form, is drawn upward and out of the upper portion of the evaporator and is returned to compressor 12 for recompression therein in an ongoing process. The lubricant-rich mixture 54 at the bottom of the evaporator shell is separately returned to the chiller's compressor by pump 34 or another such motive device, such as an eductor, for re-use therein.

Figure 2:
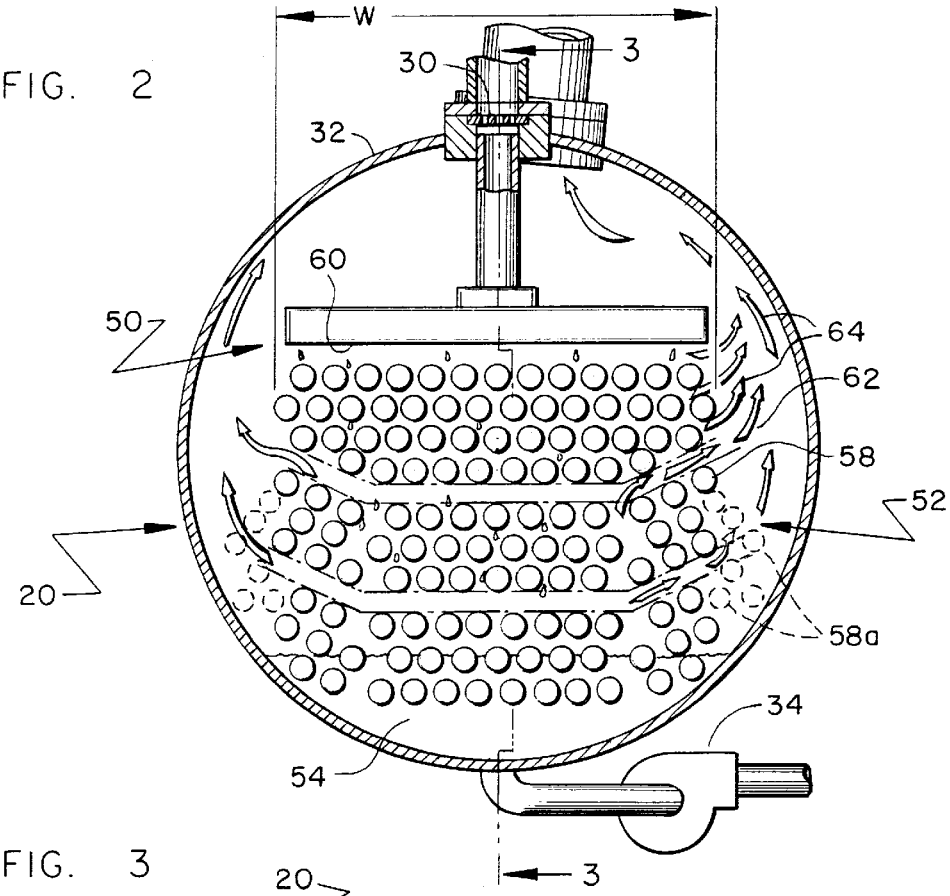
FIGS. 2 and 3 are schematic end and lengthwise cross-sectional views of the falling film evaporator of the present invention.
Figure 3:
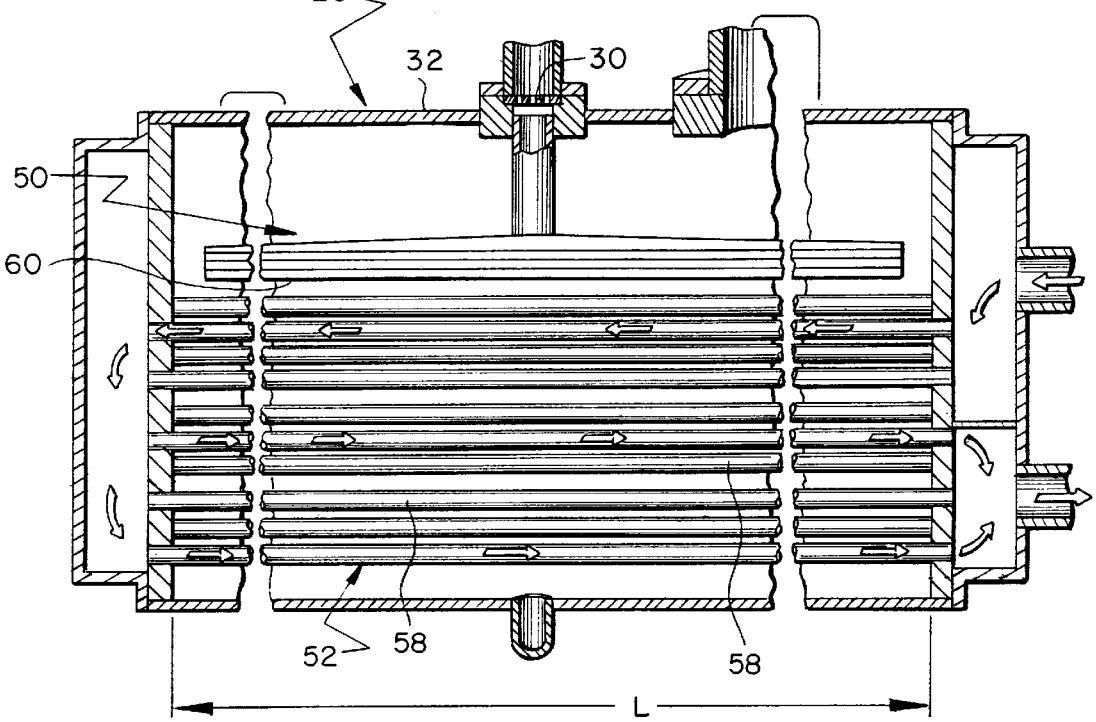

Referring additionally now to FIGS. 2 and 3, falling film evaporator 20 and refrigerant distributor 50 of the present invention are schematically illustrated in end and lengthwise cross-sectional views thereof. As will be appreciated, refrigerant distributor 50 extends along at least the large majority of the length L and width W of at least the upper portion of tube bundle 52 within evaporator 20. Of course, the greater the extent to which the length and width of the tube bundle is overlain by distributor 50, the more efficient will be the heat exchange process within evaporator 20 and the smaller need the system's refrigerant charge be as a result of the more productive use of tube surface available in the evaporator for heat transfer purposes.

Tube bundle 52 is comprised of a plurality of individual tubes 58 which are positioned in a staggered manner under distributor 50 to maximize contact with the liquid refrigerant that, as will more thoroughly be described, is expressed out of the lower face 60 of distributor 50 onto the upper portion of the tube bundle in the form of relatively large droplets. While tube bundle 52 is a horizontal bundle in the preferred embodiment, it will be appreciated that the present invention contemplates the use of tube bundles oriented otherwise as well.

In addition to the relatively large droplets of liquid refrigerant and as noted above, at least some refrigerant gas will be expressed directly out of distributor 50 and will make its way directly into the upper portion of the evaporator. So-called vapor lanes 62 can be defined within the tube bundle through which refrigerant initially vaporized by contact with the tube bundle is conducted to the outer periphery thereof. From the outer peripheral location of the tube bundle, vaporized refrigerant passes upward and around distributor 50, as indicated by arrows 64, and flows, together with any refrigerant gas that is expressed directly out of distributor 50, into the upper portion of the evaporator. Such refrigerant gas is then drawn through and out of the upper portion of evaporator 20 into compressor 12.

Figure 4:
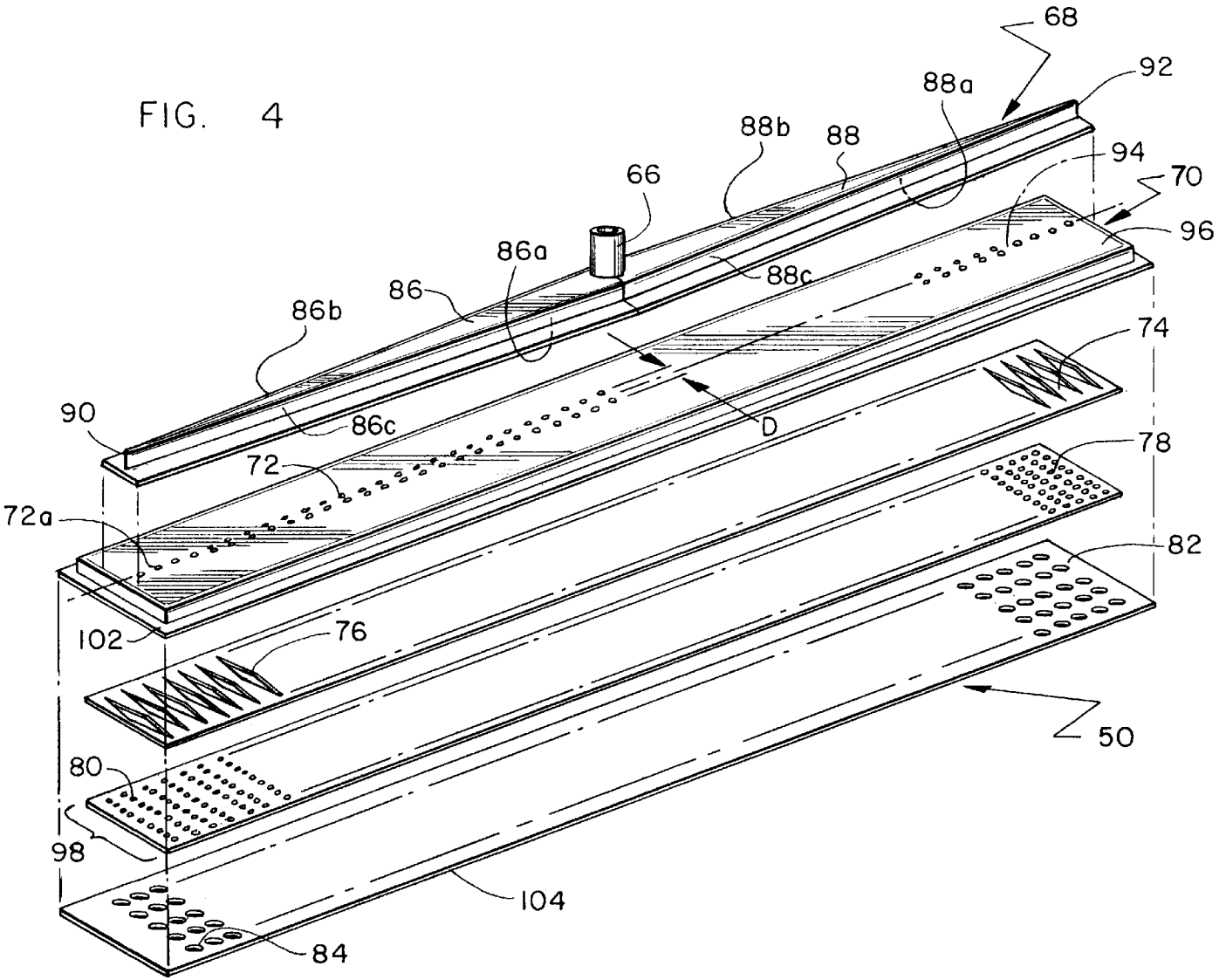
FIG. 4 is an exploded isometric view of the refrigerant distributor of FIGS. 1–3.

Referring additionally now to FIGS. 4, 5, 6, **6*a* and 7, distributor 50 includes: an inlet pipe 66; a first stage distributor section 68 which overlies a cover portion 70 in which stage one injection holes 72 and 72*a* are defined; a second stage distributor plate 74, which fits-up within cover portion 70, defines a plurality of individual diamond-shaped slots 76 and overlies a stage two injection plate 78 in which stage two injection holes 80 are defined; and, a bottom plate 82 in which stage three distribution apertures 84** are defined.

First stage distributor section 68, in the preferred embodiment, has two branches 86 and 88 into which the two-phase refrigerant received through inlet 66 is directed. As will further be described, distribution of the two-phase refrigerant mixture received into the evaporator can be controlled/facilitated by flow directing apparatus disposed in the distributor inlet location the purpose of which is to appropriately apportion flow into the branches of the first stage portion of the distributor.

It is important to note, however, and referring particularly to FIG. **6*a*, that by virtue of the fact that second expansion device 30 is disposed proximate the inlet distributor 50, it advantageously acts not only to expand the two-phase refrigerant mixture and cause cooling and a pressure drop therein but causes turbulence in and the mixing of the separate phases of that mixture immediately prior to its entry into the distributor. By locating expansion device 30 proximate inlet pipe 66 of distributor 50, stratification in the refrigerant mixture, which will have developed in the course of its flow through the piping leading to evaporator 20**, is advantageously reduced or eliminated. Consequently it is assured that a refrigerant mixture of a consistent and generally homogenous nature is delivered to the inlet of the distributor which significantly enhances the efficiency of the distributor with respect to its refrigerant distribution function.

Branch passages 86*a* and 88*a*, which are defined by branches 86 and 88 of first stage distributor section 68 and plate 70, are preferably but need not necessarily be four-sided and rectangular in cross-section with the cross-sectional area thereof decreasing in a direction away from inlet 66. In the preferred embodiment, the terminal ends 90 and 92 of branches 86 and 88 are pointed when viewed from above with sides 86*b* and 86*c* of passage 86 and sides of 88*b* and 88*c* of passage 88 converging to line contact at those ends. It is to be noted that the use of blunt rather than pointed terminal ends may increase the ease of fabrication of the distributor. In sum, passages 86*a* and 88*a* of branches 86 and 88 are preferably configured to be of continuously decreasing cross section in a direction away from inlet 66. The general nature of such configuration and flow therethrough is described in U.S. Pat. No. 5,836,382, assigned to the assignee of the present invention and incorporated herein by reference. It is to be noted that although branches 86 and 88 and branch passages 86*a* and 88*a* are illustrated as being equal in length, they need not be, so long as refrigerant is appropriately apportioned to them in accordance with their individual volumes as will further be described.

Branch passages 86*a* and 88*a* overlie stage one injection holes 72 and 72*a* of plate 70. Injection holes 72 run essentially the entire axial length of cover portion 70, along the axial centerline 94 of top face 96 thereof. As is illustrated, injection holes 72 run in pairs for the majority of the length of cover portion 70. In the preferred embodiment, the distance D between individual pairs of injection holes decreases in a direction away from inlet 66 to the branch passages, generally in conformance with the decreasing cross-sectional area of the branch passages 86*a* and 88*a*. Single injection holes 72*a*, disposed generally on centerline 94 of cover portion 70, will preferably be found at the axial ends of cover portion 70 where passages 86*a* and 88*a* are in their final stages of convergence.

Individual pairs of injection holes 72 and/or single injection holes 72*a* each overlie a diamond-shaped cutout 76 in second stage distributor plate 74. As will be appreciated from the drawing figures, second stage distributor plate 74 fits up within cover portion 70 so that the two-phase refrigerant that is forced by pressure through injection holes 72 and 72*a* flows into the associated individual diamond-shaped slots 76 that are defined by plate 74.

Slots 76, are, in essence of the same nature and effect as branch passages 86*a* and 88*a* of the first stage portion of the distributor in that they define, together with cover portion 70 and stage two injection plate 78, individual flow passages which are of generally the same four-sided, rectangular nature which decrease in cross-section in a direction away from where refrigerant is received into them. Diamond-shaped slots 76 run, however, in a direction transverse of centerline 94 of plate-like member 70, as opposed to the axial orientation of branch passages 86*a* and 88*a* of the first stage distributor portion, so as to effectuate the even distribution of two-phase refrigerant across the transverse width W of the tube bundle. In sum, the flow path defined by the second stage of distribution is, in the preferred embodiment, comprised of a plurality of individual passages, each of which decrease in cross-sectional area in a downstream flow direction and each of which are in flow communication with at least one of holes 72 and/or 72*a* and at least one, and preferably several, as will be described, of holes 80.

It is to be appreciated that initial axial distribution of the incoming refrigerant mixture within distributor 50 followed by transverse distribution across its width is contemplated and preferred but that initial transverse followed by axial distribution is possible. It is also to be appreciated that slots 76 need not be diamond-shaped although they will generally be of some converging shape in a downstream direction.

Stage two injection plate 78, in which stage two injection holes 80 are formed, fits up tightly within cover portion 70 against second stage distributor plate 74 such that diamond-shaped slots 76 of second stage distributor plate 74 each overlie one transversely oriented row 98 of stage two injection holes 80 defined in stage two injection plate 78.

As will be appreciated now from Drawing FIGS. 6 and 7, the positioning of stage one injection holes 72 and 72*a* of cover portion 70, diamond-shaped slots 76 of second stage distributor plate 74 and stage two injection holes 80 of second plate-like member 78 are preferably such that all of injection holes 72 and 72*a* and stage two injection holes 80 lie on the axis 100 of the diamond-shaped slot 76 with which they are associated. It will also be noted, however, that stage one injection holes 72 and 72*a* are preferably located so as not to directly overlie any of stage two injection holes 80. Further and as will more thoroughly be described, stage three distribution apertures 84, in addition to being relatively large-sized, are preferably aligned/positioned such that none of stage two injection holes 80 directly overlie them.

Generally speaking, the location of first stage injection holes 72 and 72*a* is optimized to ensure that even distribution of liquid refrigerant along the entire length of the distributor is established. As such, the preferred embodiment locates ejection holes 72 and 72*a* in an array along the bottom of passages 86a and 88a. Holes 72 and 72*a* may additionally be positioned with varying degrees of density along the distributor axis to even out biases that may occur in the axial first stage distribution process. For the most part, however, holes 72 and 72*a* are evenly distributed along the length of the distributor.

Stage two injection holes 80 are located, once again, along the axis 100 of diamond-shaped slots 76. By locating these holes along the axis of the individual diamond-shaped slots 76 they overlie, allowance is made for slight variation in the fit-up of plates 74 and 78 within cover 70 that may result from the distributor fabrication process. That is, small misalignments of rows 98 of injection holes 80 with respect to the axes 100 of diamond-shaped channels 76 do not significantly affect the distribution process. It is to be noted that holes 80 could be located generally along the edges of diamond-shaped slots 76 rather than being generally arrayed along the centerline thereof. That kind of placement of holes 80, while providing some advantage in that liquid refrigerant will tend to collect at the edges of the diamond-shaped slots, runs the risk that a the slight misalignment of plates 74 and 78 might cause a significant number of holes 80 to be covered. As will further be described, holes 80 could also be spaced unevenly along the length of slots 76 so as to purposefully cause "tailored" rather than uniform distribution of refrigerant across the tube bundles such as when the geometry or tube pattern of the tube bundle overlain by distributor 50 makes non-uniform refrigerant distribution advantageous.

With respect to bottom plate 82 of distributor 50, its peripheral edge portion 104 fits, in the preferred embodiment, up into flush contact with flange portion 102 of cover portion 70 and is attached thereto, such as with an adhesive or by welding, so as to ensconce members 74 and 78 between itself and cover portion 70. Second stage distributor plate 74 fits up flush against undersurface 106 of cover portion 70 and second plate-like member 78 fits up flush against plate 74. These two elements are there retained, likewise by use of an adhesive or by spot welding, so as to create stage three distribution volume 108 internal of the distributor.

In operation, two-phase liquid refrigerant and any oil entrained therein is received in inlet 66 of first stage distributor section 68 and is proportionately directed into branch passages 86*a* and 88*a*. By virtue of the design of the refrigerant distributor of the present invention, the pressure of the refrigerant mixture as it enters the distributor need only be on the order of a few p.s.i. greater than the pressure that exists external of the distributor in the evaporator shell. In that regard, in one embodiment of the present invention foreseen to be used by applicants in a centrifugal chiller system, the pressure of the refrigerant mixture entering the distributor is approximately 5 p.s.i. above the 50 p.s.i.g. pressure that exists internal of the evaporator shell where the refrigerant to be used is the one referred to as R-134A.

Due to the receipt of this mixture in the location where passages 86*a* and 88*a* are at their widest and due to the convergence of those passages in a direction away from inlet 66, the velocity of the mixture will be maintained essentially constant as it travels away from inlet 66 and downstream through passages 86*a* and 88*a* and there will be little pressure drop in that mixture during such travel. As a result, two-phase refrigerant at essentially constant pressure will be found to be flowing through passages 86*a* and 88*a* when chiller 10 is in operation and the continuous flow of two-phase refrigerant through all of the stage one injection holes 72 and 72*a* occurs. Such flow results from the pressure differential that exists between the relatively higher pressure interior of the first and second stages in distributor 50 and the lower downstream pressure interior of the distributor and the evaporator shell in which it is contained. The continuous flow of refrigerant out of the relatively small stage one injection holes 72 and 72*a* is, as noted, essentially along the entire length L of the tube bundle which distributor 50 overlies. In the preferred embodiment, holes 72 and 72*a* are of relatively very small diameter, on the order of 3/32 of an inch or so.

As a result of the continuous expression, at an essentially constant pressure and velocity, of two-phase refrigerant out of passages 86*a* and 88*a* through stage one injection holes 72 and 72*a* into the widest portion of individual diamond-shaped slots 76 of second stage distributor plate 74, two-phase refrigerant will likewise continuously be delivered to and distributed transversely within distributor 50, across the width W of the tube bundle which it overlies, with little pressure drop therein and at an essentially constant velocity during the course of its flow through the diamond-shaped slots. This is, once again, due to the converging geometry and decreasing cross-sectional areas of the individual branches of diamond-shaped slots 76 in the downstream flow direction and the essentially continuous receipt of two-phase mixture at a uniform pressure and velocity in the central portion of those slots where they are at their widest.

While the flow of the refrigerant mixture through diamond-shaped slots 76 is at essentially constant velocity and pressure, that constant velocity and pressure will, in the preferred embodiment, be different from the constant velocity and pressure of the mixture flowing through the first stage distributor portion. That difference is as a result of the passage of the two-phase mixture through relatively small injection holes 72 and 72*a*, which is accompanied by a drop in the pressure thereof, and the relatively very short length of the diamond-shaped slots as compared to the length of the branch passages through which the mixture flows in the first stage distributor portion. In that regard, the pressure of the mixture as it flows through diamond-shaped slots 76, in the aforementioned chiller embodiment where the refrigerant used is R-134A and the pressure of the refrigerant as it enters the distributor is 5 p.s.i. greater than the pressure in the evaporator shell, is about 2.5 p.s.i. less than the pressure found in the first stage of distribution. The velocity of the mixture, while essentially constant in the diamond-shaped slots, is, in that embodiment, approximately two times greater in the second stage of distribution than in the first.

In general effect however, two-phase refrigerant flow in each individual one of diamond-shaped slots 76 across the width of the distributor is characteristically the same, in terms of minimized pressure drop and essentially constant flow velocity, as the flow that occurs along the length of the distributor in first stage distributor passages 86*a* and 88*a*. The net result, with respect to first and second stage distribution in distributor 50, is that the two-phase mixture of refrigerant received in inlet 66 of the distributor 50 is distributed along the length and across the width thereof in a continuous manner, with relatively little pressure drop and at essentially constant velocity, while the chiller is in operation. As a result, two-phase refrigerant is made uniformly available internal of the distributor for delivery across the entire length L and width W of tube bundle 52 which distributor 50 overlies.

Because the two-phase refrigerant mixture remains at a pressure which is nominally higher than evaporator pressure after its initial length and widthwise distribution in the first and second stages of distribution, a third stage of distribution is preferably, but not mandatorily, provided for internal of the distributor. In that regard, a significant amount of the kinetic energy exists in the nominally higher pressure refrigerant mixture after its distribution across the length and width of the distributor. Such energy will preferably be reduced or eliminated immediately prior to the delivery of liquid refrigerant portion thereof out of the distributor and into contact with the upper portion of tube bundle 52 in order to assure that efficient heat exchange contact is made between the liquid refrigerant and the tubes in the tube bundle.

What occurs in the third stage of distribution is the relatively high-energy impact of the refrigerant which is expressed out of stage two distribution holes 80 with the upper surface of bottom plate 82 (remembering that the distribution apertures 84 defined in bottom plate 82 are not aligned with the stage two injection holes). As a result of such impact and of the lower pressure which is found in distributor volume 108, due to the relatively large size and number of distribution apertures 84, the kinetic energy of the refrigerant is released internal of the distributor and lower energy two-phase refrigerant, essentially at evaporator pressure, will be found to exist throughout the distribution volume.

The now lower-energy liquid refrigerant found in volume 108 together with any oil that has made its way into this distributor location trickles out of the distribution volume, typically over the peripheral edges of relatively large distribution apertures 84, while the vapor portion thereof is expressed out of volume 108 but generally through the central portion of those distribution apertures. It will be appreciated that the shape of distribution apertures 84, as well as the shape of first stage injection holes 72 and 72*a* and second stage injection holes 80, need not be circular and that many shapes, including but not limited to appropriately positioned slot-like shapes are contemplated. Therefore, the terms "holes" and "apertures", as used herein, are meant simply to convey the concept of "openings". In the preferred embodiment, however, holes 72, 72*a* and 80 as well as apertures 84 are circular with apertures 84 being on the order of ¼ to ⅜ inches in diameter.

The efficient operation of falling film evaporator 20 is predicated on the deposition of liquid refrigerant onto the upper portion of tube bundle 52 at relatively low velocity and in relatively low-energy droplet form, the creation by such droplets of a film of liquid refrigerant around the individual tubes in the tube bundle and the falling of any refrigerant which remains in the liquid state after contact with a tube, still in low-energy droplet form, onto other tubes lower in the tube bundle where a film of liquid refrigerant is formed similarly therearound. Uniform distribution across the top of tube bundle 52 is made possible by the proximity of lower face 60 of distributor 50 to the upper portion of the tube bundle, the low-energy nature of the refrigerant which is delivered out of distributor 50, the uniform internal distribution of that refrigerant across the length and width of the tube bundle internal of the distributor before its delivery thereonto and the relatively large number of apertures through which refrigerant is delivered out of distribution volume 108 onto the tube bundle.

The trickle-down of liquid refrigerant through the tube bundle is continuous with more and more of the remaining liquid refrigerant being vaporized in the process of downward flow and contact with tubes in the lower portion of the tube bundle. As will be noted, referring back to FIG. 2, it is contemplated that at least some tubes 58*a*, shown in phantom in the lower portion of the tube bundle, may reside outside of the width W of the upper portion of tube bundle 52 since, by appropriate tube staggering, the outward trickling of liquid refrigerant can be effected in a downward direction.

The transfer of heat from the fluid flowing internal of the individual tubes 58 to the film of liquid refrigerant formed thereon is a highly efficient process and, in the end, only a relatively very small percentage of the liquid refrigerant and essentially all of the lubricant delivered into the distributor 50 makes its way to and pools in the bottom of the evaporator where a minor percentage of the individual tubes 58 of tube bundle 52 are found. This relatively small portion of the individual tubes in tube bundle 52, typically numbering 25% or fewer thereof, vaporizes much of the remaining liquid refrigerant in the pool and leaves a mixture at the bottom of the evaporator which has a relatively very high concentration of lubricant. That mixture is returned to the compressor for re-use therein, such as by pump 34, an eductor or a flush system of the type taught in assignee's above-referenced U.S. Pat. No. 5,761,914.

It will be appreciated that if the third stage of distribution, the purpose of which is to reduce the pressure of/remove kinetic energy from the refrigerant mixture received into the evaporator prior to its being deposited onto the tube bundle, is not employed, splashing and spraying of relatively high-energy liquid refrigerant off of the tubes in the upper portion of the tube bundle will result (even though distribution of the two-phase refrigerant mixture across the entire length and width of the tube bundle will have successfully been achieved internally of the distributor by the first and second stages of distribution). A portion of such splashed liquid refrigerant would, if permitted to be created, be carried directly upward and out of the evaporator in mist form together with refrigerant gas being drawn out of the evaporator by the compressor or would fall to the bottom of the evaporator without having come into heat exchange contact with any of the tubes in tube bundle 52. Both of those circumstances diminish the efficiency of the heat exchange process in the evaporator and increase the power consumption of the chiller. By employing the third stage of distribution, which removes a significant amount of the refrigerant's kinetic energy, it is assured that essentially all of the liquid refrigerant that is expressed out of distributor 50 will be deposited onto tube bundle 52 and will come into low-energy contact with at least one or more individual tubes thereof.

Because of the uniform refrigerant distribution achieved by distributor 50 and because the vaporization process is so highly efficient within evaporator 20, the amount of refrigerant with which chiller 10 is charged can be reduced significantly. Still further, because of the ability of distributor 50 to achieve efficient and uniform distribution of a two-phase refrigerant mixture, the size of the refrigerant charge needed to operate the chiller is reduced and the need for a separate vapor-liquid separator component in chiller 10 is eliminated which, like the reduction of the refrigerant charge, significantly reduces the cost of manufacture and use of chiller 10. Still further, because uniform distribution of two-phase refrigerant is achieved by the distributor of the present invention with the use of a relatively low differential pressure between the refrigerant mixture as initially received into the and the pressure which exists outside of the distributor interior of the evaporator shell, distributor 50 need not be dramatically strong or structurally reinforced or resort to structural gimmicks to accommodate the increased internal pressures that may purposefully be caused to be developed in other, less efficient refrigerant distributors so as to force refrigerant flow through and to all reaches of the distributor.

Referring additionally now to Drawing FIGS. 8, 9 and 10, arrangements for apportioning two-phase refrigerant received into evaporator 20 for initial axial distribution therein are described. As has been mentioned, the two-phase refrigerant mixture received into distributor 50 will preferably be appropriately apportioned to the individual branch passages of the distributor's first stage distributor portion by which initial axial distribution of the mixture is achieved. That distribution must be in proportion to the relative volumes of the individual branch passages (of which there can be more than two).

Where such branch passages are two in number and equal in volume, half of the incoming refrigerant mixture will preferably be caused to flow into each one thereof. Where, however, the distributor is asymmetric, such as where the inlet to the first stage distribution portion is not centered, as in the case of the FIG. 8 embodiment, so that one of the branch passages defines a larger volume than the other, the incoming refrigerant mixture must be apportioned accordingly or the efficiency of the refrigerant distribution process internal of the evaporator and the efficiency of the heat exchange process therein will be degraded.

Referring first to the FIG. 8 embodiment, inlet guide vanes 300 are useful to help turn the flow of the refrigerant mixture into the branch passages 302*a* and 302*b* of asymmetric first stage distribution portion 304. The vanes function with little restriction to flow and, therefore, cause little pressure drop in the refrigerant mixture. The guide vanes split refrigerant flow and guide separate portions of the refrigerant mixture through individual vane channels 306 which has the beneficial effect of reducing flow stratification in the region of distributor inlet 308. The result is the delivery of well-mixed, two-phase mixture in appropriate quantities out of the guide vane structure and into the distributor passages without appreciable pressure drop. Once again, however, it is to be noted that the disposition of an expansion device proximate the distributor inlet, as illustrated in FIG. 6*a*, has generally the same effect.

As will be appreciated from FIG. 8, a greater portion of the mixture delivered into and through inlet 306 makes its way into branch passage 302*b* which is longer and defines a greater volume than branch passage 302*a*. The amount of refrigerant delivered into passages 302*a* and 302*b* is determined by flow splitter 310 which is a vertical partition the position of which is in and/or under inlet 308 and which is selected so as to divide refrigerant flow into asymmetric branch passages 302*a* and 302*b* in accordance with the respective volumes of those passages.

Referring now to FIGS. 9 and 10 and depending upon the height-to-width ratio of the distributor, the performance of the first stage distribution portion of the distributor, whether it is symmetric or asymmetric, may also be improved by the use of rotary distributor 400 rather than inlet guide vanes. Two-phase refrigerant mixture flows through inlet 402 and is then forced to make a 90° turn by capped end 404 of the inlet pipe 406 in this embodiment. The refrigerant mixture flows out of rotary distributor 400, directed by louvers 408, into branch passages 410*a* and 410*b* of first stage distributor portion 412. Since the interior side walls 414 of first stage distributor portion 412 are in close proximity to rotary distributor 400, a portion of the two-phase refrigerant exiting rotary distributor 400 impacts the interior side walls of the first stage distributor portion creating excellent mixing at the inlet location. The tendency of the two-phase mixture to separate into stratified flow in the proximity of the inlet thereto is reduced thereby. It is to be noted that louvers 408 may be fabricated so as to be straight (as shown) but could be curved. It is also to be noted that elimination of axially directed louvers 408*a* and use only of transverse-directed louvers 408*b* might still further reduce flow stratification since all of the refrigerant mixture directed out of rotary distributor 400 would, in that case, flow directly and immediately into contact with the interior side walls of the distributor, thereby enhancing mixing prior to its flow axially within the distributor.

It is important, as noted above, that the relationship between the velocity of the flow stream within the distributor inlet and the velocity thereof within the first and second stages of distribution are as close to being the same as possible. Changes in velocity are as a result of acceleration of the flow. Acceleration of flow leads to mixture separation and to stratification of the two-phase mixture internal of the distributor. By matching inlet velocity and the velocity of the mixture in the first and second stages of the distribution process, such as by the use of devices in the nature of the ones identified above, acceleration in the flow of the two-phase mixture and the stratification thereof within the first and second stages of distribution is minimized. In sum, while the use of guide vanes and flow apportioning apparatus is not mandatory in all instances, the use thereof in appropriate instances will enhance the distribution process.

Referring now to FIGS. 11 and 12, an alternate design for a first stage distributor portion is identified. In that regard, whereas first stage distributor section 68, in the preferred embodiment, defines branch passages of constant height and decreasing volume by the convergence of its sides, the same effect is obtained in the embodiment of FIGS. 11 and 12 by the use of a first stage distributor portion 500 the branch passages of which are of constant width but of constantly decreasing height in a direction away from inlet 502. This embodiment may, however, be somewhat more difficult to fabricate.

Referring now to FIG. 13, an alternate embodiment of the present invention is illustrated wherein the first and second stages of refrigerant distribution described with respect to the preferred embodiment of FIG. 4 are combined but the essence of each one thereof is retained. In that regard, in the distributor 50*a* of FIG. 13, inlet 66*a* delivers refrigerant into flow passage 600, the geometry of which combines the converging aspects of the first and second stages of distribution in the preferred embodiment. Plate 602, which defines the geometry of passage 600, fits up within solid cover portion 604.

A plate 606, which is similar to plate 78 of the preferred embodiment of FIG. 4 in its definition of a plurality of apertures 608, underlies passage 600 and is likewise ensconced in cover 604. A bottom plate 610, similar to bottom plate 82 of the preferred embodiment, is attached to the bottom of cover plate 602 and cooperates with plate 606 to define a distribution volume therebetween similar to distribution volume 108 in the preferred embodiment.

While the distributor of this embodiment has fewer components and generally operates in the same manner as the distributor of the preferred embodiment, it is to be appreciated that because the geometry of passage 600 is irregular, due to diamond-shaped sub-branches 612 that branch off of main passage 614, and does not converge continuously in a downstream flow direction from where refrigerant is received into it, the flow of the refrigerant mixture therein will not be as easily controlled or constant in terms of velocity and pressure as in the preferred embodiment. Therefore, while the performance of the distributor of the embodiment of FIG. 13 mimics the performance of the distributor of the preferred FIG. 4 embodiment, that performance will be somewhat less efficient and the distribution of refrigerant by it less uniform. As such, the objects of the present invention, to the extent they include uniform refrigerant distribution, maintenance of flow velocity and maintenance of uniform pressure and the like, all of which affect the size of the refrigerant charge needed in a chiller where distributor 50*a* is used, are not as efficiently or fully met as compared to the distributor of the preferred embodiment.

Referring now to FIG. 14, an instance is depicted where it may be advantageous for distributor 50 to distribute refrigerant across the top of tube bundle 52 in a "tailored", other than uniform manner. In that regard, in the embodiment of FIG. 14 it will be appreciated that because the configuration of tube bundle 52 is such that its central portion is vertically deeper and contains more tubes than are found at its outside edges, there will be significantly more tube surface available for wetting in the central portion of the tube bundle.

In such instances, it may be advantageous to distribute a greater amount of refrigerant over the top of the central portion of the tube bundle to ensure that sufficient refrigerant is made available for heat transfer in that portion of the bundle while a lesser amount of refrigerant is deposited onto the outside edge portions thereof where fewer tubes are found. In that case, stage two injection holes 80 which underlie diamond-shaped slots 76 in distributor 50 would purposefully be unevenly spaced along the length of slots 76, as is illustrated, to ensure that more refrigerant is made available to the central portion of the tube bundle than is made available to the sides thereof which are vertically more shallow in terms of the number of tubes and available heat transfer surface found there. While such tailored/non-uniform distribution is somewhat disruptive of uniform flow velocity of the refrigerant mixture as it is distributed across the width of the distributor, that disadvantage is, potentially and in some instances, foreseen to be more than made up for by ensuring that refrigerant is deposited onto the tube bundle in quantities and at locations where it will best be taken advantage of in terms of the overall heat exchange process that occurs within the tube bundle.

Finally and referring to FIG. 15, a still further embodiment, suggesting modification of the shape of what had previously been referred to as diamond-shaped slots 76 in distributor 50, shown in phantom in FIG. 15, is depicted. In the FIG. 15 embodiment, an irregular "star burst" kind of slot is depicted which is fed from above, as in the earlier embodiments, through first stage injection holes 72, likewise shown in phantom. In this case, however, refrigerant is then directed through relatively narrow individual channels 700 to individual stage two injection holes 702 which are strategically positioned to provide for the uniform or tailored widthwise distribution of the refrigerant, as dictated by the pattern of the tube bundle.

As will be appreciated in view of the alternate embodiments of FIGS. 14 and 15, uniformity of distribution/maintenance of uniform flow velocity in the refrigerant mixture subsequent to its axial distribution with respect to the tube bundle is not as critical as is the management of the axial distribution of the refrigerant mixture and the maintenance of a generally constant flow velocity thereof during the axial distribution process. This is because the length of a tube bundle will typically be many times greater than its width so that any adverse distribution effects, such as can occur when flow velocity changes, are exacerbated with respect to the axial distribution process. As such, the "tailoring" of refrigerant flow in the widthwise distribution of the refrigerant mixture so as to deposit more or less refrigerant in locations across the width of the tube bundle and/or the tolerance for changes in flow velocity in the widthwise distribution process is contemplated and falls within the scope of the present invention, even if not the case with respect to its preferred embodiment.

While the present invention has been described in the context of a preferred embodiment and several alternatives and modifications thereto, it will be appreciated that many other alternatives and modifications to the invention will be apparent to those skilled in the art and fall within its scope. Similarly, when referring to the "first stage distributor portion" in the claims which follow, what is generally being referred to is the portion and/or structure of the distributor through which two-phase refrigerant received into the distributor is conveyed across one of the width or lengthwise dimensions of the distributor while reference to the "second stage distributor portion" is generally to that portion and/or structure of the distributor which causes the two-phase mixture to flow in the other of the length and widthwise directions.

With that in mind, what is claimed is:

1. A falling film evaporator for use in a refrigeration chiller system comprising:

a shell;

a tube bundle disposed in said shell; and a refrigerant distributor disposed in said shell and overlying said tube bundle so that liquid refrigerant expressed out of said distributor is deposited thereonto, said distributor including an inlet through which a two-phase mixture of refrigerant is received and at least a first stage distributor portion and a second stage distributor portion, said first stage distributor portion receiving said two-phase mixture of refrigerant from said inlet and internally flowing said mixture through a flow path in one of a first and a second directions with respect to said tube bundle, said second stage distributor portion receiving said two-phase mixture of refrigerant from said first stage distributor portion and internally flowing said mixture through a flow path in the other of said two directions with respect to said bundle, at least said first stage distributor portion configured to maintain the velocity of said two-stage refrigerant mixture essentially constant as it flows therethrough.

2. The falling film evaporator according to claim 1 wherein said tube bundle is comprised of a plurality of horizontal tubes that run in an axial direction within said shell and has an upper portion proximate said distributor, said first and said second stage distributor portions flowing said two-phase refrigerant mixture across the large majority of the axial length and transverse width of the upper portion of said tube bundle within said distributor prior to the expression of refrigerant thereoutof and into the interior of said shell.

3. The falling film evaporator according to claim 2 wherein the cross-sectional areas of both said first and said second stage distributor portions through which flow of said refrigerant mixture occurs generally decrease in a downstream flow direction from the location in each one thereof where said mixture is first received.

4. The falling film evaporator according to claim 3 wherein said first stage distributor portion flows said two-phase refrigerant mixture in said axial direction and said second stage distributor portion flows said two-phase refrigerant mixture transversely of said tube bundle.

5. The falling film evaporator according to claim 4 wherein said first stage distributor portion has one or more generally axial branch passages into which said two-phase refrigerant mixture flows from said inlet, the cross-sectional areas of each of said branch passages generally decreasing in a direction away from the location where said two-phase refrigerant mixture is received thereinto.

6. The falling film evaporator according to claim 5 wherein said refrigerant distributor has a third stage distributor portion, said third stage distributor portion receiving said two-phase refrigerant mixture from said second stage distributor portion and being configured to reduce the kinetic energy thereof prior to the deposit of the liquid refrigerant portion of said mixture onto said tube bundle.

7. The falling film evaporator according to claim 6 further comprising a flow splitter, said flow splitter apportioning the flow of two-phase refrigerant mixture received from said inlet into each of said branch passages of said first stage distributor portion in accordance with the respective volumes thereof.

8. The falling film evaporator according to claim 6 wherein the pressure in said third stage distributor portion is essentially the same as the pressure exterior of said distributor within said shell when said chiller system is in operation.

9. The falling film evaporator according to claim 1 wherein said refrigerant distributor defines a distribution volume internal thereof into which said two-phase refrigerant mixture is received from said second stage distributor portion prior to the delivery of refrigerant out of said distributor and into said shell.

10. The falling film evaporator according to claim 9 wherein the velocity of said refrigerant mixture as it flows through said first stage distributor portion and said second stage distributor portion is maintained generally constant when said chiller system is in operation.

11. The falling film evaporator according to claim 9 wherein the pressure in said first stage distributor portion is greater than the pressure in said second stage distributor portion and wherein the pressure in said second stage distributor portion is greater than the pressure in said distribution volume when said chiller system is in operation.

12. The falling film evaporator according to claim 9 wherein refrigerant is delivered into said second stage distributor portion from said first stage distributor portion through a first plurality of holes and wherein said flow path defined by said second stage distributor portion is comprised of a plurality of individual flow passages, each of said individual flow passages being in flow communication with at least one of said first plurality of holes.

13. The falling film evaporator according to claim 12 wherein refrigerant is delivered into said distribution volume from said second stage distributor portion through a second plurality of holes and wherein refrigerant is delivered out of said distribution volume and into said shell through a plurality of apertures, said apertures overlying said tube bundle and being larger than but generally unaligned with said holes through which said two-phase refrigerant mixture is delivered out of said second stage distributor portion and into said distribution volume.

14. The falling film evaporator according to claim 13 wherein said tube bundle contains vertically more tubes in a first portion thereof than are found in a second portion thereof and wherein said holes through which said refrigerant mixture is delivered out of said second stage distributor portion into said distribution volume are positioned so as to deliver relatively more refrigerant into said distribution volume at a location which facilitates the flow of relatively more liquid refrigerant out of said apertures where said apertures overlie said first portion of said tube bundle.

15. The falling film evaporator according to claim 9 wherein the flow of said two-phase refrigerant mixture through both said first stage distributor portion and through said second stage distributor portion is generally through a flow path of continuously decreasing cross-section in a downstream flow direction.

16. The falling film evaporator according to claim 9 wherein said first stage distributor portion has at least two branch passages into which said two-phase refrigerant mixture flows from said inlet and further comprising a flow-splitter, said flow-splitter apportioning said two-phase refrigerant mixture into said at least two branch passages generally in accordance with the respective volumes of each one thereof.

17. The falling film evaporator according to claim 16 further comprising an expansion device, said expansion device being in flow communication with said refrigerant distributor inlet as well as vertically above and proximate thereto so as to cause the mixing of the individual phases of said two-phase refrigerant mixture immediately prior to the delivery of said refrigerant mixture to said refrigerant distributor inlet thereby reducing stratification in said mixture.

18. The falling film evaporator according to claim 1 wherein said refrigerant distributor has a third stage distributor portion, said third stage distributor portion receiving said two-phase refrigerant mixture from said second stage distributor portion and being configured to reduce the kinetic energy of said refrigerant mixture prior to the delivery of the liquid portion thereof out of said third stage distributor portion.

19. The falling film evaporator according to claim 18 wherein said tube bundle is comprised of a plurality of tubes that run in an axial direction within said shell and has an upper portion proximate the underside of said distributor, said first and said second stage distributor portions internally flowing said two-phase refrigerant mixture across at least the large majority of the axial length and transverse width of said upper portion of said tube bundle prior to the delivery of said two-phase refrigerant mixture from said second stage distributor portion into said third stage distributor portion.

20. The falling film evaporator according to claim 19 wherein the flow of said refrigerant mixture through said second stage distributor portion is at a lower pressure and higher velocity than the flow of said mixture through said first stage distributor portion.

21. The falling film evaporator according to claim 19 wherein the flow paths followed by said two-phase refrigerant mixture through both of said first and said second stage distributor portions generally decrease in cross-sectional area in a downstream flow direction with respect to the location where said mixture is first received thereinto.

22. The falling film evaporator according to claim 19 wherein the kinetic energy of said refrigerant mixture is reduced in said third stage distributor portion by the impingement of said refrigerant on a surface of said third stage distributor portion.

23. The falling film evaporator according to claim 19 wherein said first stage distributor portion has at least two branch passages into which two-phase refrigerant mixture received through said inlet is communicated and further comprising a flow splitter, said flow splitter apportioning the flow of the two-phase refrigerant mixture received through said distributor inlet into said at least two branch passages in accordance with the respective volumes thereof.

24. The falling film evaporator according to claim 19 further comprising an expansion device, said expansion device being disposed proximate and above said refrigerant distributor inlet and having the effect of causing the mixing of said two-phase mixture and reducing stratification therein immediately prior to the entry of said two-phase mixture into said distributor inlet.

25. The falling film evaporator according to claim 18 wherein the delivery of the two-phase refrigerant mixture from said first stage distributor portion into said second stage distributor portion and the delivery of said two-phase refrigerant mixture from said second stage distributor portion into said distribution volume is, in each case, through a plurality of holes and where the delivery of refrigerant out of said distribution volume and out of said distributor into the interior of said shell is through a plurality of apertures, generally none of the holes through which said refrigerant mixture is delivered from said first stage distributor portion into said second stage distributor portion overlying the holes through which said refrigerant mixture is delivered out of said second stage distributor portion into said distribution volume and generally none of the holes through which said refrigerant mixture is distributed out of said second stage distributor portion into said distribution volume overlying the apertures through which refrigerant is delivered out of said distribution volume of said distributor and into the interior of said evaporator, the apertures through which refrigerant is delivered out of said distribution volume and into the interior of said evaporator being larger than the holes through which said refrigerant mixture is delivered from said first stage distributor portion into said second stage distributor portion and the holes through which said refrigerant mixture is delivered from said second stage distributor portion into said distribution volume.

26. Apparatus for distributing a two-phase refrigerant within a falling film evaporator comprising:

an inlet, said two-phase refrigerant mixture being received into said distributor through said inlet;

a first stage distributor portion, said first stage distributor portion receiving said two-phase refrigerant mixture from said inlet and defining a flow path for said two-phase refrigerant mixture which it generally oriented in a first flow direction and which maintains the velocity of the flow of said refrigerant therethrough generally constant; and a second stage distributor portion, said second stage distributor portion receiving said two-phase refrigerant mixture from said first stage distributor portion and defining a flow path for refrigerant which is generally oriented in a direction different from said first flow direction.

27. The distributor apparatus according to claim 26 wherein said apparatus has width and lengthwise dimensions, flow of said two-phase refrigerant mixture through said flow path defined by said first stage distributor portion and through said flow path defined by said second stage distributor portion positioning said two-phase mixture generally along the length and generally across the width of the distributor.

28. The distributor apparatus according to claim 27 further comprising a third stage distributor portion, said third stage distributor portion receiving said two-phase refrigerant mixture from said second stage distributor portion and being configured to reduce the kinetic energy thereof.

29. The distributor apparatus according to claim 28 wherein said refrigerant mixture passes through a first plurality of holes in order to flow from said first stage distributor portion into said second stage distributor portion and a second plurality of holes in order to flow from said second stage distributor portion into said third stage distributor portion.

30. The distributor apparatus according to claim 29 wherein said flow paths defined by said first and second stage distributor portions generally decrease in cross-sectional area in a downstream flow direction and wherein said distributor defines a plurality of apertures through which refrigerant flows out of said third stage distributor portion, the size and number of said apertures being sufficiently large to ensure that the pressure internal of said third stage distributor portion is essentially the same as the pressure which exists exterior of said distributor in the evaporator in which it is disposed.

31. The distributor apparatus according to claim 29 wherein said distributor defines a plurality of apertures through which refrigerant flows out of said third stage distributor portion, said apertures being generally unaligned with said second plurality of holes, said second plurality of holes being oriented generally across the width of said distributor and being positioned so as to selectively deliver refrigerant to said third stage distributor portion at predetermined locations therein.

32. The distributor apparatus according to claim 29 wherein said flow path defined by said first stage distributor portion is comprised of two branch passages, each of said branch passages generally decreasing in cross-section in a downstream flow direction and further comprising flow-splitting apparatus disposed in said distributor so as to apportion the refrigerant mixture received into said distributor to said branch passages in accordance with the respective volumes of each one thereof.

33. The distributor apparatus according to claim 29 wherein said third stage distributor portion defines a distribution volume and a plurality of apertures through which refrigerant flows thereoutof, said second plurality of holes being sized so that the pressure in said second stage distribution is higher than the pressure in said distribution volume.

34. The distributor apparatus according to claim 29 wherein said flow path defined by said second stage distributor portion is comprised of a plurality of individual flow passages, each of said individual flow passages being in flow communication with at least one of said first plurality of holes and with at least one of said second plurality of holes.

35. The distributor apparatus according to claim 29 further comprising apparatus for reducing the stratification of the two-phase refrigerant mixture received into said distributor, said apparatus generally being disposed at the location where said mixture enters said first stage distributor portion.

36. A refrigerant distributor comprising:

an inlet;

a cover, said cover defining a first plurality of holes generally along the length thereof;

a first stage distributor section, said first stage distributor section being in flow communication with said inlet and defining, in cooperation with said cover, a first flow path of decreasing cross-sectional area in a downstream flow direction, said first flow path being in flow communication with said first plurality of holes defined by said cover;

a second stage distributor plate, said second stage distributor plate disposed below said first stage distributor section;

an injection plate, said injection plate defining a second plurality of holes, said injection plate and said second stage distributor plate cooperating to define a second flow path, downstream of said first flow path, said second stage injection plate defining a second plurality of holes, both said first plurality of holes and said second plurality of holes being in flow communication with said second flow path; and a bottom plate, said bottom plate defining a plurality of apertures, said bottom plate cooperating with said injection plate to define a distribution volume internal of said distributor, said distribution volume being in flow communication with both said plurality of apertures and with said second plurality of holes.

37. The refrigerant distributor according to claim 36 wherein said apertures in said bottom plate are generally unaligned with said second plurality of holes, refrigerant issuing out of said second plurality of holes impinging on the surface of said bottom plate in which said apertures are defined.

38. The distributor according to claim 37 wherein said second flow path is comprised of a plurality of individual flow passages, each of said individual flow passages being in flow communication with at least one of said first plurality of holes and with at least one of said second plurality of holes, the flow of refrigerant through said first flow path and through said plurality of individual flow passages making refrigerant available internal of said distributor essentially along the entire length and across the entire width of said distributor.

39. The refrigerant distributor according to claim 38 wherein said second plurality of holes are positioned, with respect to said individual flow passages so as to deliver refrigerant into said distribution volume at predetermined locations and in predetermined quantities across the width thereof.

40. A falling film evaporator for use in a refrigeration chiller system comprising:

a shell into which a two-phase mixture of refrigerant is received;

a tube bundle disposed in said shell; and a refrigerant distributor disposed in said shell and overlying said tube bundle so that liquid refrigerant expressed out of said distributor is deposited thereonto, said distributor having an inlet and defining a flow path by which said two-phase mixture is dispersed across generally the entire length and width of said tube bundle prior to exiting said distributor, said distributor defining a distribution volume downstream of said flow path in flow communication therewith, the pressure in said distribution volume being lower than the pressure in said flow path, refrigerant flowing out of said flow path, into said distribution volume and impinging on a surface by which said distribution volume is defined so as to reduce the kinetic energy of said refrigerant prior to the delivery of the liquid portion thereof out of said distributor and into contact with said tube bundle.

41. The falling film evaporator according to claim 40 wherein the pressure internal of said distribution volume is essentially the same as the pressure in said shell when said chiller system is in operation.

42. The refrigerant distributor according to claim 41 wherein said flow path generally has two branches that generally converge toward the lengthwise ends of said distributor, there being a plurality of converging sub-branches that extend off of said flow path generally to the widthwise edges of said distributor along generally the entire length of each of said branches of said flow path.

43. The falling film evaporator according to claim 42 wherein said distribution volume has a lengthwise and a widthwise dimension and is disposed beneath said flow path within said distributor, wherein said refrigerant distributor defines a plurality of holes communicating between said flow path and said distribution volume and wherein said surface on which refrigerant flowing out of said flow path impinges defines a plurality of apertures, said apertures being generally larger than and unaligned with said holes.

44. The falling film evaporator according to claim 41 wherein said refrigerant flow path is comprised of two discrete portions, the first of said discrete distributor portions being a first stage distributor portion and the second of said portions being a second stage distributor portion, said refrigerant mixture flowing through said first stage distributor portion in an axial direction, generally along at least the majority of the length of said tube bundle, at a first, essentially constant, velocity.

45. The falling film evaporator according to claim 44 wherein refrigerant mixture flowing through said second stage distributor portion flows generally across the width of said tube bundle, refrigerant flowing out of said second stage distributor portion and into said distribution volume through a plurality of holes.

46. The falling film evaporator according to claim 45 wherein said holes are generally located across the width of said distributor so as to result in the flow of refrigerant into said distribution volume in generally uniform quantities across the width of said distributor.

47. The falling film evaporator according to claim 45 wherein said refrigerant flowing out of said second stage distributor portion and into said distribution volume flows through a plurality of holes, said holes being positioned, with respect to said distribution volume, to purposefully deliver a greater amount of refrigerant into said distribution volume at predetermined locations across the width thereof so as to make a greater amount of liquid refrigerant available for deposit onto said tube bundle in locations where a vertically greater number of individual tubes underlie said distributor.

48. A method of distributing two-phase refrigerant within the falling film evaporator of a refrigeration chiller comprising the steps of:

disposing a tube bundle under a distributor within said evaporator;

delivering two-phase refrigerant from an expansion device in said chiller into said distributor;

flowing said two-phase refrigerant mixture within said distributor so as to position said mixture across the large majority of the length and width of said tube bundle internally of said distributor;

reducing the kinetic energy of the two-phase refrigerant mixture internal of said distributor; and depositing liquid refrigerant in relatively low-velocity droplet form onto said tube bundle.

49. The refrigerant distribution method according to claim 48 wherein said positioning step includes the steps of first flowing two-phase refrigerant received from said expansion device in one of an axial and a transverse flow direction internally of said distributor; and, then flowing said two-phase refrigerant mixture in the other one of said axial and transverse flow directions internally of said distributor.

50. The refrigerant distribution method according to claim 49 comprising the further step of maintaining the velocity of flow of said refrigerant mixture essentially constant as it flows in at least said axial and transverse directions.

51. The refrigerant distribution method according to claim 49 wherein said reducing step includes the step of causing the pressure of said refrigerant to be reduced generally to the pressure that exists internal of said evaporator prior to said depositing step.

52. The refrigerant distribution method according to claim 49 wherein said step of first flowing two-phase refrigerant received from said expansion device in one of an axial and a transverse flow direction internally of said distributor includes the step of flowing said two-phase refrigerant in said one direction at a first pressure and wherein said step of then flowing said two-phase refrigerant mixture in the other one of said axial and transverse flow directions includes the step of flowing said two-phase refrigerant mixture in the other said direction at a second pressure, said second pressure being lower than said first pressure but higher than the pressure that exists internal of said evaporator.

53. The refrigerant distribution method according to claim 49 wherein said step first flowing two-phase refrigerant received from said expansion device in one of an axial and a transverse flow direction comprises the steps of defining a plurality of axially-running branch passages through which said two-phase refrigerant received from expansion device flows; apportioning said two-phase refrigerant mixture received from said inlet into said branch passages in accordance with the respective volumes of said branch passages;

and flowing said two-phase refrigerant received from said expansion device in said axial flow direction through said branch passages.

54. The refrigerant distribution method according to claim 53 comprising the further step of positioning said expansion device above said distributor and sufficiently proximate thereto so that the mixing of said two-phase refrigerant that results from the passage of said two-phase refrigerant through said expansion device has the effect of reducing the stratification in the flow of said two-phase refrigerant as it enters said distributor.

55. The refrigerant distribution method according to claim 49 wherein said steps of flowing two-phase refrigerant received from said expansion device in one of an axial and a transverse flow direction and flowing said two-phase refrigerant mixture in the other one of said axial and transverse flow directions each include the step of flowing said two-phase refrigerant through a flow path of generally continuously decreasing cross-section.

56. The refrigerant distribution method according to claim 49 comprising the steps of maintaining the velocity of flow of said refrigerant in said first direction at a first, essentially constant flow velocity and maintaining the velocity of flow of said refrigerant mixture in said second flow direction at a second and higher, essentially constant flow velocity.

57. The refrigerant distribution method according to claim 49 wherein said refrigerant mixture is driven by pressure in said first flow direction, in said second flow direction and into said distribution volume, the pressure of the refrigerant mixture as it flows in said first direction and as it flows in said second direction being higher than the pressure of refrigerant found in said distribution volume.

58. The refrigerant distribution method according to claim 49 wherein said depositing step includes the step of flowing refrigerant out of said distribution volume through a plurality of apertures and comprising the further steps of driving said refrigerant mixture through a first plurality of holes between said steps of flowing said refrigerant mixture in said first direction and flowing said refrigerant mixture in said second flow direction; and, driving said refrigerant mixture through a second plurality of holes prior to said step of reducing the kinetic energy of said refrigerant.

59. The refrigerant distribution method according to claim 49 comprising the further steps of defining a distribution volume internal of said distributor; placing said distribution volume in flow communication with the interior of said evaporator so that said distribution volume is at essentially the same pressure as the interior of said evaporator; and, flowing said two-phase refrigerant mixture into said distribution volume prior to said depositing step.

60. The refrigerant distributor according to claim 59 wherein said reducing step includes the step of causing refrigerant to impinge on a surface of said distribution volume within said distributor.

61. The refrigerant distribution method according to claim 60 wherein said step of first flowing two-phase refrigerant mixture received from said expansion device in one of an axial and transverse flow direction includes the step of maintaining the flow velocity of said two-phase refrigerant mixture generally constant and wherein said step of then flowing said two-phase refrigerant mixture in the other one of said axial and transverse flow directions includes the step of maintaining the velocity of the flow of said refrigerant mixture essentially constant.

62. The refrigerant distribution method according to claim 61 wherein the step of flowing two-phase refrigerant mixture in said axial flow direction includes the step of maintaining the flow velocity of said two-phase refrigerant mixture generally constant and permitting the flow velocity of said two-phase refrigerant mixture, as it flows in said transverse flow direction, to vary so as to achieve the selective non-uniform distribution of liquid refrigerant across the width of said tube bundle.

63. A method of distributing two-phase refrigerant, within a falling film evaporator in a refrigeration system, by use of a refrigerant distributor disposed internal of the evaporator shell and into which the two-phase mixture is received from an expansion device, comprising the steps of:

positioning a tube bundle in said evaporator;

positioning said distributor above said tube bundle so that said distributor generally overlies the top portion thereof;

delivering two-phase refrigerant from said expansion device into said distributor;

flowing, in a first flowing step, said two-phase refrigerant in a first direction and at an essentially constant speed through a first passage within said distributor;

passing, in a first passing step, said two-phase mixture out of said first flow passage;

flowing, in a second flowing step, said two-phase refrigerant in a second direction and at an essentially constant speed in a second flow passage within said distributor;

passing, in a second passing step, said two-phase refrigerant mixture out of said second flow passage;

reducing the pressure of the refrigerant delivered out of said second flow passage internal of said distributor to a pressure that is generally the same as the pressure exterior of the distributor within the evaporator shell; and depositing liquid refrigerant onto the upper portion of said tube bundle.

64. The method according to claim 63 comprising the further step of causing refrigerant delivered out of said second flow passage in said reducing step to impinge on a surface internal of said distributor so as to reduce the kinetic energy thereof.

65. The method according to claim 64 wherein said tube bundle, said distributor and said first flow passage are all generally axially oriented in said evaporator and wherein said second passage is oriented transversely of said tube bundle, said first and said second flowing steps accomplishing the distribution of said two-phase mixture internally of said distributor generally along the entire length and across the entire width of said distributor and, correspondingly, generally along the entire length and across the entire width of the upper portion of said tube bundle.

66. The method according to claim 65 comprising the further step of dividing said first flow passage into a plurality of branch passages, each of said branch passages being of generally decreasing cross-sectional area in a downstream flow direction; and, generally apportioning said two-phase refrigerant mixture received from said expansion device into said plurality of branch passages in accordance with the respective volumes thereof.

67. The method according to claim 66 comprising the further step of dividing said second flow passage into a plurality of individual flow passages, each of said individual flow passages being in flow communication with at least one of said plurality of branch passages and the cross-sectional areas thereof generally decreasing in a downstream flow from the location said refrigerant mixture is received thereinto.

68. The method according to claim 66 comprising the further step of reducing the pressure of the two-phase mixture that passes out of said first flow passage into said second flow passage to a pressure less than the pressure of said two-phase mixture as it is received into said distributor but which is greater than the pressure of the refrigerant as it is delivered out of said distributor and into the shell of said evaporator.

69. The method according to claim 65 comprising the further step of reducing flow stratification in said refrigerant mixture immediately prior to its entry into said distributor by disposing said expansion device proximate and immediately above the inlet to said distributor.

* * * * *